US008036578B2

(12) United States Patent
Nishikawa

(10) Patent No.: US 8,036,578 B2
(45) Date of Patent: Oct. 11, 2011

(54) TONER CARTRIDGE, ADAPTOR FOR TONER CARTRIDGE, TONER CARTRIDGE ASSEMBLY AND IMAGE FORMING APPARATUS

(75) Inventor: Yoshiyuki Nishikawa, Oaska (JP)

(73) Assignee: Kyocera Mita Corporation (JP)

( * ) Notice: Subject to any disclaimer, the term of this patent is extended or adjusted under 35 U.S.C. 154(b) by 381 days.

(21) Appl. No.: 12/310,568

(22) PCT Filed: Aug. 28, 2007

(86) PCT No.: PCT/JP2007/066688

§ 371 (c)(1),
(2), (4) Date: Feb. 27, 2009

(87) PCT Pub. No.: WO2008/026605

PCT Pub. Date: Mar. 6, 2008

(65) Prior Publication Data

US 2010/0272477 A1 Oct. 28, 2010

(30) Foreign Application Priority Data

Aug. 30, 2006 (JP) ..... 2006-234615

(51) Int. Cl.
*G03G 15/08* (2006.01)

(52) U.S. Cl. ..... 399/262

(58) Field of Classification Search ..... 399/119, 399/120, 262, 263, 258, 260; 222/DIG. 1, 222/325, 575; 141/364; 220/326, 324, 315, 220/203.23, 203.19, 827, 810, DIG. 13
See application file for complete search history.

(56) References Cited

U.S. PATENT DOCUMENTS

| | | | | |
|---|---|---|---|---|
| 3,702,806 | A * | 11/1972 | Oliva | |
| 4,095,724 | A * | 6/1978 | Perusco | |
| 5,084,734 | A * | 1/1992 | Yoshino et al. | 399/262 |
| 5,089,854 | A * | 2/1992 | Kaieda et al. | 399/262 |
| 5,655,181 | A * | 8/1997 | Chadani et al. | 222/DIG. 1 |
| 5,761,584 | A * | 6/1998 | Tsuda et al. | 399/258 |
| 5,802,431 | A * | 9/1998 | Nagashima et al. | 399/262 |
| 5,866,419 | A * | 2/1999 | Meder | |
| 6,484,000 | B1 * | 11/2002 | Ogawa et al. | |
| 6,647,236 | B2 | 11/2003 | Katsuyama | |
| 6,963,713 | B2 * | 11/2005 | Isomura et al. | 399/262 |
| 7,054,581 | B2 * | 5/2006 | Yoshikawa et al. | 399/260 |
| 7,455,191 | B2 * | 11/2008 | Bhavnani | |
| D598,295 | S * | 8/2009 | Miceli et al. | |
| 7,606,521 | B2 * | 10/2009 | Noguchi et al. | |
| 2003/0180079 | A1 * | 9/2003 | Yasui et al. | |
| 2005/0123322 | A1 * | 6/2005 | Okamoto et al. | 399/258 |

FOREIGN PATENT DOCUMENTS

| | | |
|---|---|---|
| JP | 64-90469 | 4/1989 |
| JP | 6-43755 | 2/1994 |
| JP | 8-82975 | 3/1996 |
| JP | 8-314258 | 11/1996 |
| JP | 10339993 | 12/1998 |
| JP | 2003-66704 | 3/2003 |
| JP | 2003-295591 | 10/2003 |

* cited by examiner

*Primary Examiner* — Susan Lee
(74) *Attorney, Agent, or Firm* — Gerald E. Hespos; Michael J. Porco

(57) ABSTRACT

A toner cartridge (20) has a cartridge main body (21) as a container filled with a developer and a shutter mechanism (25) that opens and closes a developer discharging orifice (231) formed in the cartridge main body (21). The cartridge main body (21) has a pair of end walls (left end wall (22) and right end wall (23)) opposing each other and a barrel (24) installed between a pair of these end walls (22) and (23). A shape of a cross section of the barrel (24) orthogonal to a direction of a tube center line is set to a shape of a Reuleaux polygon.

10 Claims, 16 Drawing Sheets

+X
-X
+Y
-Y
51
36
421
321
42
41
40
43
VIIB
VI
241
242
322
222
341
342
21(20)
33
32
34
30
31
35
351
20
211
234
27
271
21

TONER CARTRIDGE, ADAPTOR FOR TONER CARTRIDGE, TONER CARTRIDGE ASSEMBLY AND IMAGE FORMING APPARATUS

BACKGROUND OF THE INVENTION

1. Field of the Invention

The present invention relates to a toner cartridge filled with a developer made of toner particles or the like, an adaptor for toner cartridge, a toner cartridge assembly, and an electrophotographic image forming apparatus to which the foregoing components are attached detachably.

2. Description of the Related Art

With an image forming apparatus applied with the electrophotographic method, an electrostatic latent image is formed by irradiating light from an exposing device onto the peripheral surface of a photoconductive drum being rotated according to image information obtained by reading a document or transmitted from another device, and a toner image is formed by supplying toner particles from a developing device onto the peripheral surface of the drum on which the electrostatic latent image is formed, after which the toner image is transferred onto a sheet of paper. The sheet bearing the transferred toner image is subjected to a fixing process by heating in a fixing device and discharged to the outside thereafter. To the image forming apparatus configured as above, a toner cartridge is attached detachably in order to replenish the developing device with a developer (toner particles or a mixture of toner particles and a carrier).

Incidentally, the toner cartridge is a consumable article and is normally stored at the site where the image forming apparatus is installed. A toner cartridge being used is replaced with a new one in store as soon as it becomes empty.

Normally, a stirring mechanism having, for example, a spiral feeder, is internally attached to such a toner cartridge. When the toner cartridge is attached to the image forming apparatus, a drive force of a drive source inside the image forming apparatus is transmitted to the stirring mechanism inside the toner cartridge. The stirring mechanism is thus driven so that a developer inside the toner cartridge is replenished to the developing device with stirring. The toner cartridge as above, however, has an inconvenience that the need to provide the stirring mechanism inside the toner cartridge increases the cost.

In order to eliminate this inconvenience, a toner cartridge described, for example, in Patent Document 1 (referred to as the bottle in JP 6-43755) is formed of a circular tubular body. The toner cartridge formed of the circular tubular body is attached to the image forming apparatus and rotated about the tube center. A spiral rib is provided to bulge on the inner peripheral surface of the circular tubular body along the full length. Accordingly, when the toner cartridge rotates, the developer inside the toner cartridge is guided by the spiral rib while it is loosened and eventually migrates toward the opening, so that it is replenished to the developing device through the opening. According to the toner cartridge of JP 6-43755 configured as above, it is possible to achieve a reduction in cost because there is no need to provide the stirring mechanism inside the toner cartridge.

With the toner cartridge of JP 6-43755, however, in a case where the toner cartridge has been stored, for example, in a vertical posture over a long period, the developer falls down to the bottom (end wall) of the toner cartridge in a vertical posture and the developer at the lower end is hardened to form lumps. In a case where the toner cartridge in a state where lumps are formed therein is attached to the image forming apparatus, even when the toner cartridge is rotated about the tube center, the lumps of the developer are hardly pulverized. This results in a problem that the developer cannot be transported toward the developing device.

Incidentally, in order to eliminate this inconvenience, the user is recommended to hold the toner cartridge in hands and shake the toner cartridge sufficiently before he or she attaches the toner cartridge to the image forming apparatus. The user, however, often forgets such a shaking operation.

SUMMARY OF THE INVENTION

An object of the invention is to provide a toner cartridge capable of loosening the developer filled inside in a reliable manner even when the toner cartridge has been stored in a vertical posture over a long period and the user forgets a shaking operation before he or she attaches the toner cartridge to the image forming apparatus, an adaptor for toner cartridge, a toner cartridge assembly, and an image forming apparatus.

In order to achieve the above and other objects, toner cartridge according to one aspect of the invention includes a cartridge main body as a container having a tubular barrel and filled with a developer, and the barrel has at least in part a portion whose outer shape of a cross section orthogonal to a direction of a tube center line is a shape of almost a curve of constant width other than a circle. It is preferable that the shape of the figure of constant width is a shape of a Reuleaux polygon.

An adaptor for toner cartridge according to another aspect of the invention includes an adaptor main body having a tubular barrel and an accommodation space for a toner cartridge in an interior thereof, and the barrel has at least in part a portion whose outer shape of a cross section orthogonal to a direction of a tube center line is a shape of almost a curve of constant width other than a circle.

A toner cartridge assembly according to still another aspect of the invention includes an adaptor that includes an adaptor main body having a tubular barrel and an accommodation space in an interior thereof, the barrel having at least in part a portion whose outer shape of a cross section orthogonal to a direction of a tube center line is a shape of almost a curve of constant width other than a circle, and a toner cartridge accommodated in the accommodation space and filled with a developer inside.

An image forming apparatus according to still another aspect of the invention includes: an apparatus main body of a box shape in which various image forming devices are provided; the toner cartridge, the adaptor for toner cartridge, or the toner cartridge assembly described above, each of which is attached detachably to the apparatus main body; an accommodation portion including an inner surface with which an outer peripheral surface of the barrel of the toner cartridge or the adaptor comes into sliding contact and an opening provided to one end face through which the toner cartridge or the adaptor is attached and detached and having a cross section in a direction orthogonal to a direction of a tube center line in a shape of a regular tetragon; a rotation mechanism configured to rotate the toner cartridge or the adaptor attached to the accommodation portion in a circumferential direction; and a transportation mechanism configured to transport the developer inside the toner cartridge to the image forming components provided inside the apparatus main body through a developer discharging orifice provided to the toner cartridge.

The above and other objects, features, and advantages of the invention will become more apparent from the following detailed description of embodiments with reference to the accompanying drawings.

BRIEF DESCRIPTION OF THE DRAWINGS

FIGS. 5A through 5F respectively show states where the reference vertex of the Reuleaux triangle is rotated from the reference position W in a counterclockwise direction up to 150° by 30° at a time.

FIGS. 6A through 6F respectively show states where the reference vertex of the Reuleaux triangle is rotated in a counterclockwise direction up to 330° by 30° at a time from the start point rotated by 180° in a counterclockwise direction from the reference position and FIG. 6G shows a sub-elliptical shape formed by a circulation trajectory of the center of gravity when the Reuleaux triangle is rotated inside a regular tetragon.

FIG. 7A is a perspective view and FIG. 7B is a cross section taken on line VIIB-VIIB of FIG. 7A.

FIG. 9A shows a state before the toner cartridge is coupled to the transportation mechanism and FIG. 9B shows a state where the toner cartridge is coupled to the transportation mechanism.

FIG. 10A shows a state where the toner cartridge is positioned at the reference position, FIG. 10B shows a state where the toner cartridge is rotated by 30° in a counterclockwise direction from the reference position, FIG. 10C shows a state where the toner cartridge is rotated by 60°, FIG. 10D shows a state where the toner cartridge is rotated by 90°, and FIG. 10E shows a state where the toner cartridge is rotated by 120°.

FIG. 12A shows a case where the angular tubular body is a regular hexagon and FIG. 12B shows a state where the angular tubular body is a regular octagon.

FIG. 13A shows a figure of constant width of a triangle type in a case where the base figure is a regular triangle and FIG. 13B shows a figure of constant width of a pentagon type in a case where the base figure is a regular pentagon.

FIG. 14A and FIG. 14B show an all accommodation type in which a barrel is entirely accommodated in an adaptor (FIG. 14A shows a state where the barrel is pulled out from the adaptor and FIG. 14B shows a state where the barrel is accommodated in the adaptor) and FIG. 14C shows a barrel partial accommodation type in which the barrel penetrates through the adaptor.

FIG. 16A shows a state before the toner cartridge is coupled to the transportation mechanism and FIG. 16B shows a state where the toner cartridge 20 is coupled to the transportation mechanism.

DETAILED DESCRIPTION OF THE PREFERRED EMBODIMENTS

Figure 1:
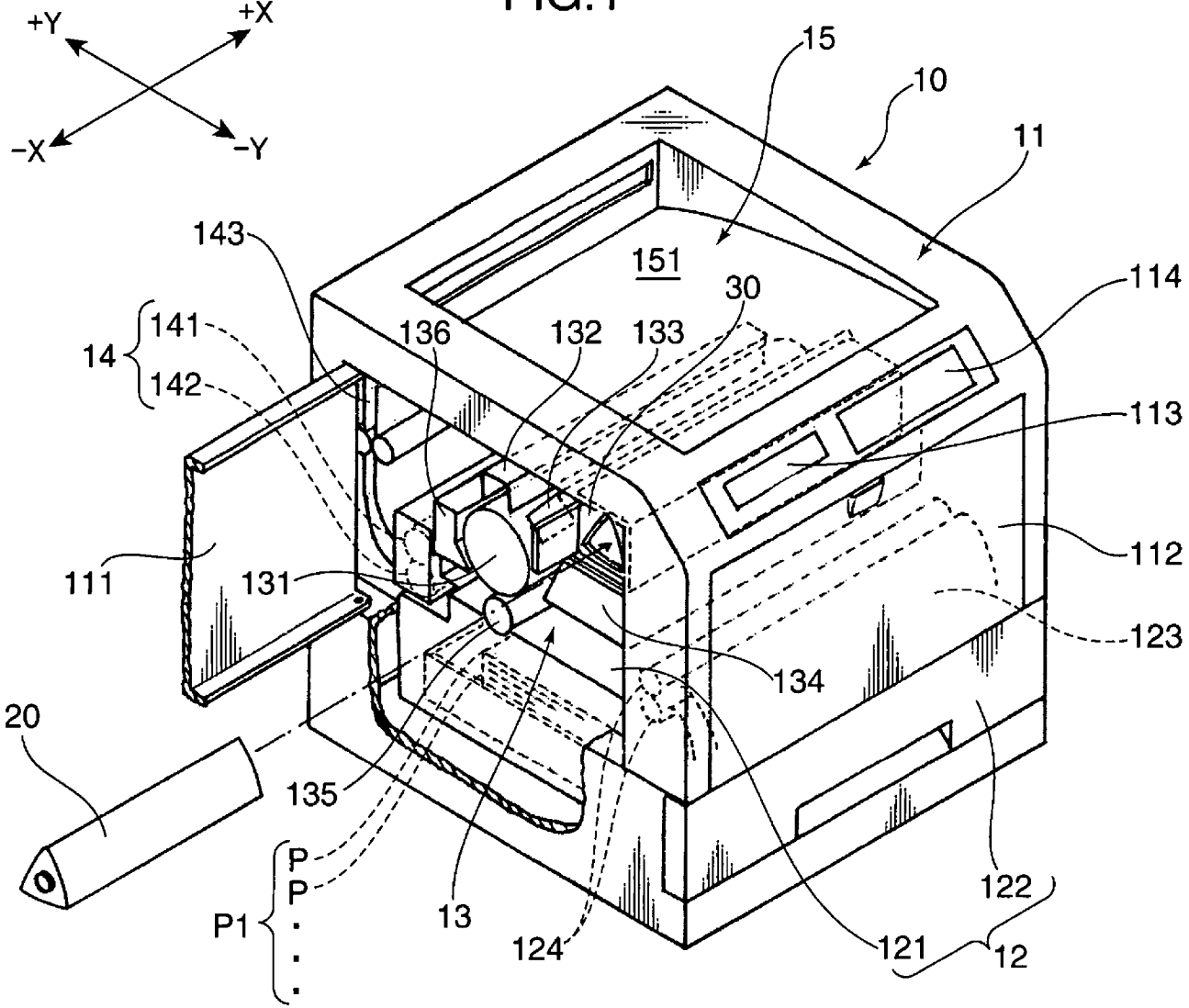
FIG. 1 is a partially notched perspective view of an outward appearance according to one embodiment of a printer to which a toner cartridge of the invention is applied and shows a state where a maintenance door is open.

Hereinafter, embodiments of the invention will be described in detail on the basis of the drawing. FIG. 1 is a partially notched perspective view of an outward appearance according to one embodiment of a printer 10 to which a toner cartridge 20 of the invention is applied and it shows a state where a maintenance door 111 is open. Referring to FIG. 1, an X-X direction is defined as the right-left direction and a Y-Y direction is defined as the front-rear direction. In particular, a −X direction is defined as leftward, a +X direction is defined as rightward, a −Y direction is defined as frontward, and +Y direction is defined as the rearward.

As is shown in FIG. 1, the printer (image forming apparatus) 10 includes a sheet storing portion 12 to store sheets P to be supplied for a printing process, an image forming portion 13 to apply an image transferring process on a sheet P picked up one by one from a sheet pile P1 stored in the sheet storing portion 12, and a fixing portion 14 to apply a fixing process on the sheet P having undergone the transferring process in the image forming portion 13, all of which are provided inside an apparatus main body 11. A sheet discharge portion 15 onto which to discharge the sheet P having undergone the fixing process in the fixing portion 14 is provided on the top of the apparatus main body 11.

The openable and closable maintenance door 111 is provided to the left side wall of the apparatus main body 11 at an almost upper half position. When the maintenance door 111 is opened, the interior of the apparatus main body 11 is exposed. A manual tray 112 serving also as the opening and closing door is provided to the front wall of the apparatus main body 11. By tilting the manual tray 112 toward the front, a sheet P can be fed into the image forming portion 13 manually via the top face thereof.

An inclined surface inclined to point downward toward the front is formed in the upper edge portion on the front face of the apparatus main body 11 and an operation panel 113 and an LCD (Liquid Crystal Display) 114 are provide on the inclined surface. Various types of operation information are inputted from the operation panel 113 and various comments for an image forming process are outputted to the LCD 114 in the form of characters.

The sheet storing portion 12 is provided with a cassette frame body 121 that is integral with the apparatus main body 11 and a predetermined number (one in this embodiment) of sheet cassette 122 loaded with a sheet pile P1 and attached to the cassette frame body 121 in such a manner that it can be pushed in and pulled out on the front side. A sheet P picked up one by one from the sheet pile P1 in the sheet cassette 122 is fed into the image forming portion 13 via a sheet feeding transportation path 123 and a register roller pair 124 provided at the downstream end of the sheet feeding transportation path 123.

The image forming portion 13 applies a transferring process on a sheet P according to image information transmitted from a computer or the like. The image forming portion 13 includes a photoconductive drum 131 provided to be rotatable about a drum axis extending in the width direction, and along the peripheral surface of the photoconductive drum 131 from atop in a clockwise direction when viewed from the left are provided a charging device 132, an exposing device 133, developing device 134, a transfer roller 135, and a cleaning device 136.

The photoconductive drum 131 is used to form an electrostatic latent image and a toner image in accordance with the electrostatic latent image on the peripheral surface thereof. In order to form satisfactory electrostatic latent image and toner image, a strong and smooth amorphous silicon layer is laminated on the peripheral surface of the photoconductive drum 131.

The charging device 132 forms charges uniformly on the peripheral surface of the photoconductive drum 131 that rotates about the center of drum in a clockwise direction when viewed from the left. The example shown in FIG. 1 adopts a method by which charges are provided onto the peripheral surface of the photoconductive drum 131 by means of corona discharging from a charging wire provided across the charging device 132. Alternatively, as a member that provides charges onto the peripheral surface of the photoconductive drum 131, the charging wire may be replaced with a charging roller configured to provide charges while is driven to rotate with the peripheral surface thereof abutting on the peripheral surface of the photoconductive drum 131.

The exposing device 133 irradiates a laser beam whose intensity is adjusted according to image data transmitted from an external device, such as a computer, onto the peripheral surface of the photoconductive drum 131 being rotated. Charges on the peripheral surface of the photoconductive drum 131 are erased partially when scanned by the laser beam. An electrostatic latent image is thus formed on the peripheral surface of the photoconductive drum 131.

The developing device 134 supplies toner particles to the peripheral surface of the photoconductive drum 131, so that the toner particles are attracted to the peripheral surface in the portion where the electrostatic latent image is formed. A toner image is thus formed on the peripheral surface of the photoconductive drum 131.

The transfer roller 135 transfers a toner image formed on the peripheral surface of the photoconductive drum 131 onto a sheet P fed beneath the photoconductive drum 131. The transfer roller 135 therefore provides the sheet P with charges charged oppositely to the polarity of the charges provided to the toner image. The transferring process on a sheet P is achieved by nipping the sheet P by the transfer roller 135 and the photoconductive drum 131 that are pressed against each other and by peeling off the toner image on the charged peripheral surface of the photoconductive drum 131 toward the surface of the sheet P that is charged oppositely.

The cleaning device 136 cleans the peripheral surface of the photoconductive drum 131 after the transferring process by removing toner particles remaining thereon. The peripheral surface of the photoconductive drum 131 cleaned by the cleaning device 136 is headed again toward the charging device 132 for the next image forming process.

The fixing portion 14 applies the fixing process by heating onto the toner image on the sheet P to which the transferring process has been applied by the image forming portion 13. The fixing portion 14 includes a heat roller 141 having a conducting heating element, such as a halogen lamp, in the housing thereof and a pressure roller 142 provided below the heat roller 141 in such a manner that the respective peripheral surfaces oppose each other. The fixing process is performed when the sheet P after the transferring process receives heat from the heat roller 141 by passing through the nip portion between the heat roller 141 driving and rotating about the center of roller in a clockwise direction when viewed from the left and the pressure roller 142 driven to rotate about the center of roller in a counterclockwise direction when viewed from the left. The sheet P having undergone the fixing process is discharged to the sheet discharge portion 15 by passing through a sheet discharging transportation path 143.

The sheet discharge portion 15 is formed by making a recess at the top of the apparatus main body 11. A sheet discharge tray 151 to receive a discharged sheet P is provided at the bottom of this recessed concave portion.

In this embodiment, an accommodation portion (toner cartridge accommodation portion) 30 formed of an angular tubular body used to detachably attach the toner cartridge 20 on the top plate of the developing device 134 is provided. A developer (toner particles or a mixture of toner particles and a carrier) filled in the toner cartridge 20 is replenished to the developing device 134 in a state where the toner cartridge 20 is attached to the accommodation portion 30 as is indicated by an alternate long and short dashed arrow of FIG. 1.

Figure 2:
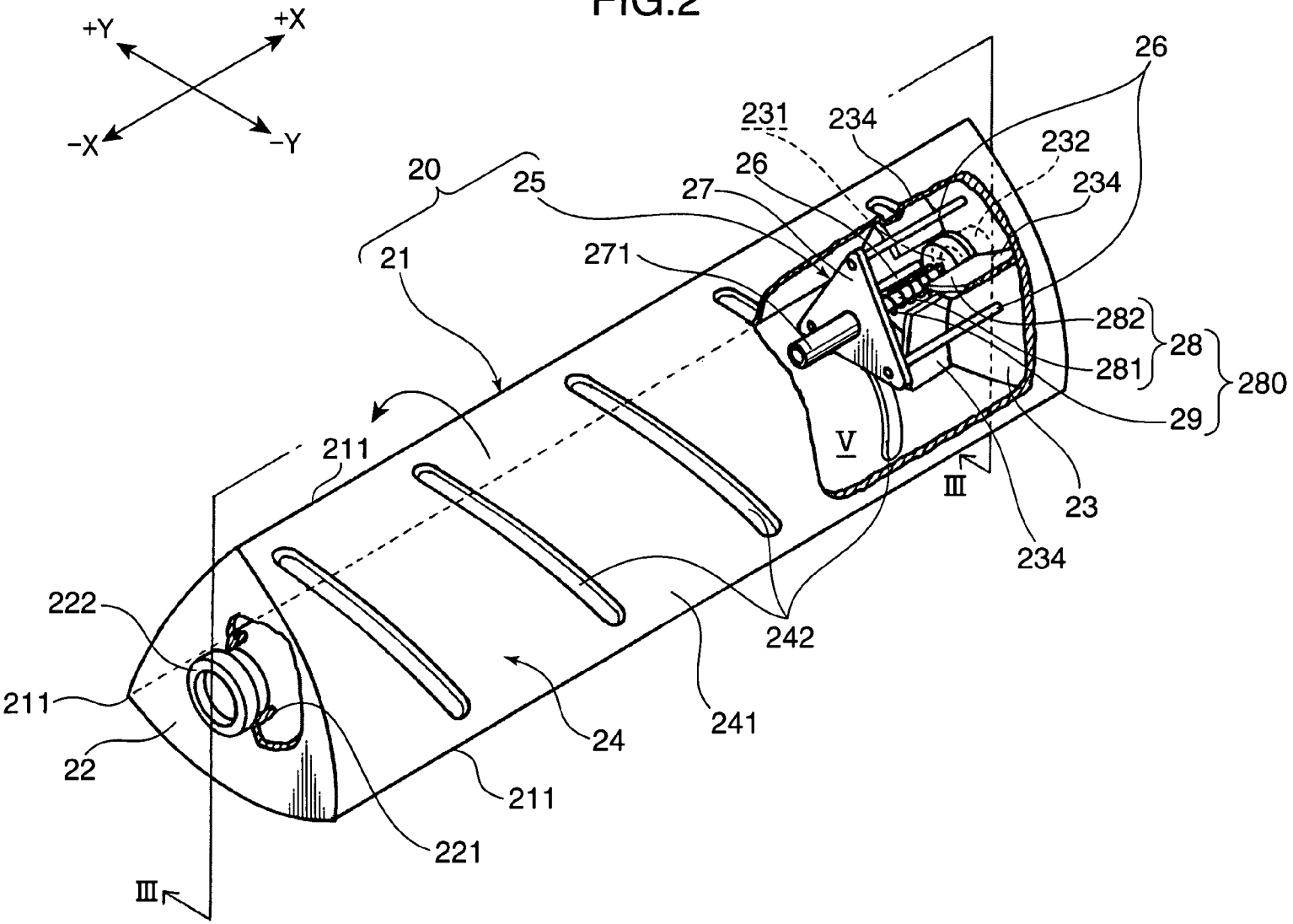
FIG. 2 is a perspective view showing one embodiment of the toner cartridge of the invention.
Figure 3:
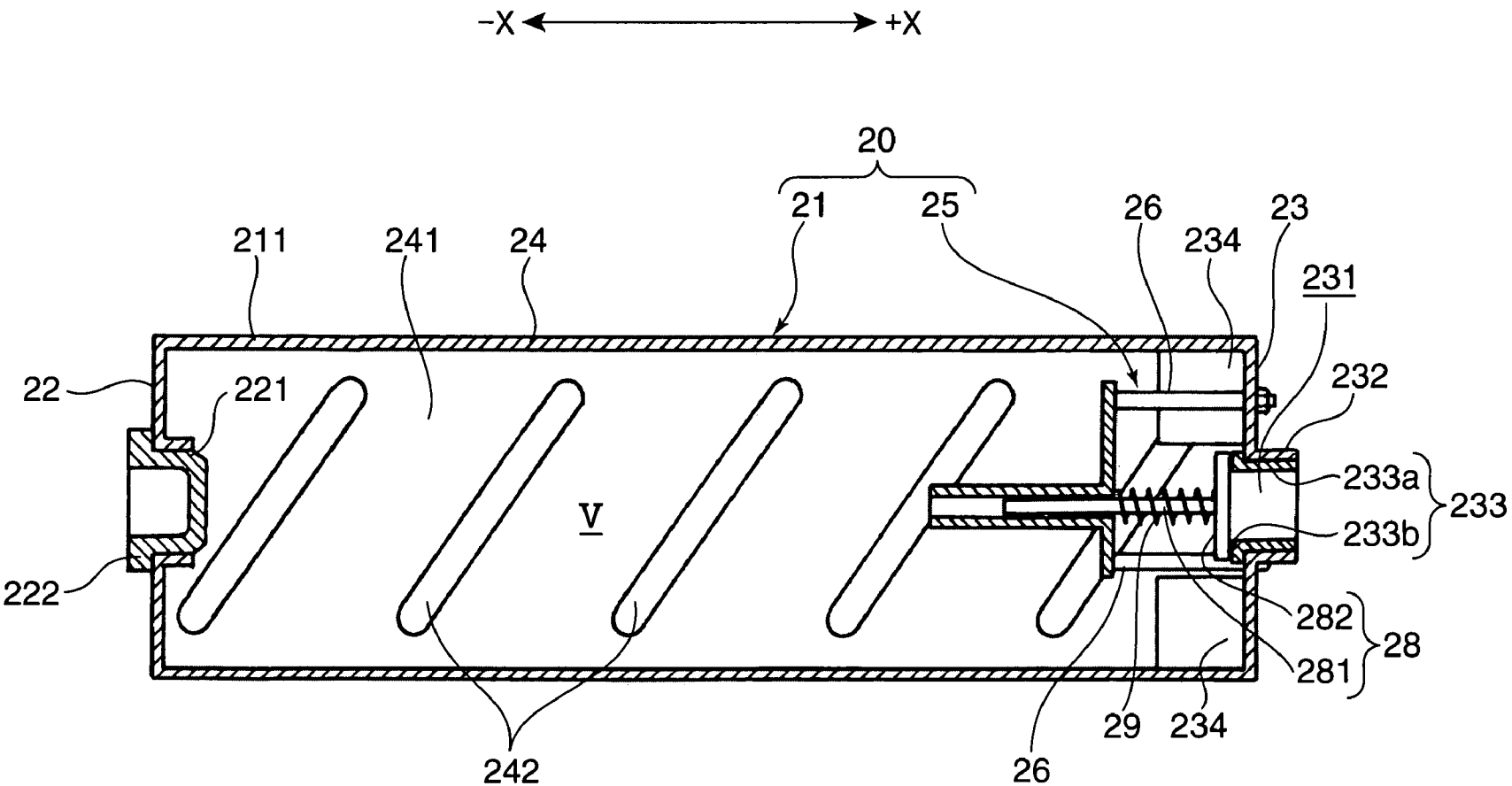
FIG. 3 is a cross section taken on line of FIG. 2.

FIG. 2 is a perspective view showing one embodiment of the toner cartridge 20 of the invention. FIG. 3 is a cross section taken on line of FIG. 2. Indications of direction in FIG. 2 and FIG. 3 using letters X and Y are the same as in FIG. 1 (X is the right-left direction (−X: leftward, +X: rightward) and Y is the front-rear direction (−Y: frontward, +Y: rearward)).

As is shown in FIG. 2, the toner cartridge 20 is of a basic configuration having a cartridge main body 21 as a container filled with the developer inside and a shutter mechanism 25 internally attached to the cartridge main body 21 and used to discharge the developer inside the cartridge main body 21.

The cartridge main body 21 includes a pair of end walls in the right-left direction (left end wall 22 and right end wall 23) and a tubular barrel 24 installed between a pair of the end walls 22 and 23. A developer filling chamber V is defined in a space surrounded by a pair of the end walls 22 and 23 and the barrel 24.

A circular developer filling orifice 221 is provided to the left end wall 22 at the center position. A cap 222 shaped like a circular column is press-fit to the developer filling orifice 221 in a state where the developer is filled into the developer filling chamber V through the developer filling orifice 221. A circular developer discharging orifice 231 is provided to the right end wall 23 at the center position. It is configured in such a manner that the developer inside the developer filling chamber V is discharged toward the developing device 134 through the developer discharging orifice 231 in a state where a circular shutter 282 of the shutter mechanism 25 described below is opened.

A coupling cylinder 232 (FIG. 3) is provided to right end wall 23 on the outer surface side so as to protrude and surround the developer discharging orifice 231. An elastic tubular body 233 made of an elastic material, such as rubber, is press-fit to the developer discharging orifice 231 from inside the developer filling chamber V. The elastic tubular body 233 includes a tube main body 233*a* having the major diameter dimension set to be slightly larger than the minor diameter dimension of the coupling cylinder 232 and a flange 233*b* formed along the left end edge of the tube main body 233*a*.

Accordingly, by press-fitting the tube main body 233*a* in the coupling cylinder 232 from the side of the developer filling chamber V, the flange 233*b* adheres tightly to the left surface of the right end wall 23. The elastic tubular body 233 is thus attached to the developer discharging orifice 231. The circular shutter 282 described below adheres tightly to the flange 233*b* due to a closing operation of the shutter mechanism 25. It thus becomes possible to prevent the developer inside the developer filling chamber V from leaking through the developer discharging orifice 231 in a reliable manner.

Each of the end walls 22 and 23 is set to be of the shape of the Reuleaux triangle. The shape of the Reuleaux triangle is shown as an example in this embodiment. It should be appreciated, however, that, besides this shape, the walls may be set to be of the shapes of various Reuleaux polygons, such as the Reuleaux pentagon and the Reuleaux heptagon. Alternatively, as will be described in a modification below, each wall may be set to be of the shape of a curve of constant width other than Reuleaux polygons.

The barrel 24 is formed by bridging respective unit arc plates 241 long in the right-left direction and processed on the short side to bend along the arcs of the circular edge portions of the respective end walls 22 and 23 between the respective edge portions of an arc shape provided to each of a pair of the end walls 22 and 23 in the shape of the Reuleaux triangle. Accordingly, the barrel 24 is of the shape of the Reuleaux triangle same as that of the respective end walls 22 and 23 when viewed in a cross section taken in a direction orthogonal to the direction of the barrel center line.

Angular portions 211, which are a part of the outer peripheral surface of the barrel 24, are formed between the adjacent unit arc plates 241 of the cartridge main body 21. It is configured in such a manner that these angular portions 211 come into sliding contact with the four inner wall surfaces of the accommodation portion 30.

Figure 4:
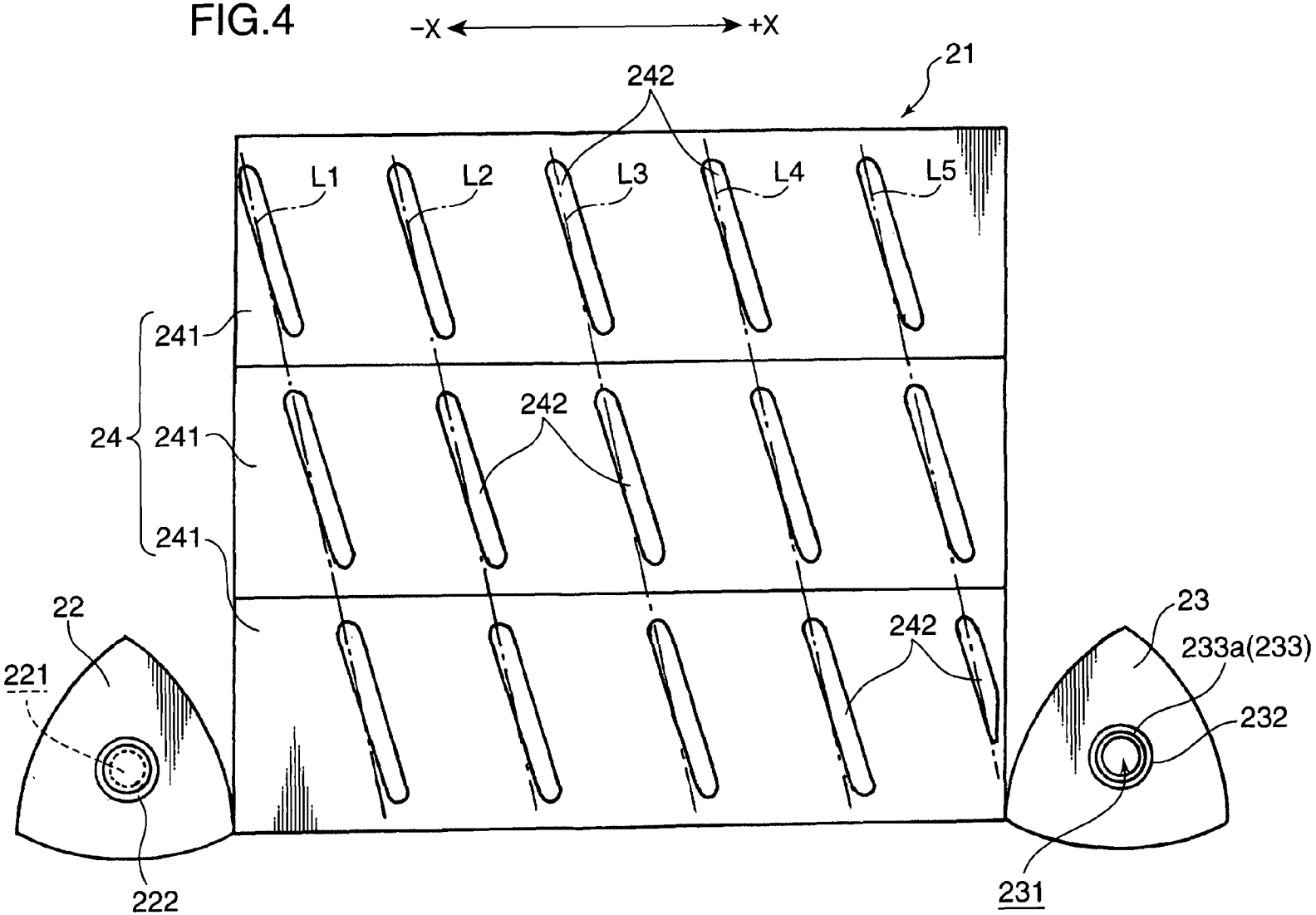
FIG. 4 is a development view showing an outer surface side of a toner cartridge main body shown in FIG. 2.

FIG. 4 is a development view showing the outer surface side of the cartridge main body 21 shown in FIG. 2. Indications of direction in FIG. 4 using a letter X are the same as in FIG. 1 (−X: leftward, +X: rightward). Transfer ribs (ribs for developer transportation) 242 in a plurality of strips, which are formed by pushing up the respective unit arc plates 241 from the outer surface side (on the principal sheet surface of FIG. 4) to the inner surface side, are provided to bulge on each unit arc plate 241 of the barrel 24 of the cartridge main body 21. Incidentally, in the example shown in FIG. 4, five strips are provided to each unit arc plate 241 at regular pitches in the right-left direction.

Each transfer rib 242 is provided with an inclination so as to point downward from the left to the right in FIG. 4. Accordingly, by rotating the toner cartridge 20 in a counterclockwise direction when viewed from the left of FIG. 2, the developer filled in the developer filling chamber V starts to migrate toward the developer discharging orifice 231 on the right as it is pushed by the respective transfer ribs 242 with stirring.

The respective transfer ribs 242 on the adjacent unit arc plates 241 are disposed along reference straight lines L1 through L5 indicated by an alternate long and short dashed line of FIG. 4. The reference straight lines L1 through L5 are straight lines inclined by a predetermined angle with respect to a direction in which the cartridge main body 21 extends. In a state where the barrel 24 is formed, they are connected to one another and form a spiral line of a right-handed screw. In short, in a state where the cartridge main body 21 in a developed state as shown in FIG. 4 is formed into a tube, the reference straight lines L1 through L5 are connected to one another in a spiral manner.

Meanwhile, the respective transfer ribs 242 are along the reference straight lines L1 through L5 whereas they have an angle of inclination slightly different from that of the reference straight lines L1 through L5. More specifically, the angle of inclination of the respective transfer ribs 242 with respect to the direction in which the cartridge main body 21 extends is set smaller than the angle of inclination of the reference straight lines L1 through L5. The purpose of this configuration is to allow the adjacent end portions of the respective transfer ribs 242 along the same reference straight lines L1 through L5 in the adjacent unit arc plates 241 to oppose each other in a state where the cartridge main body 21 is formed into a tube.

When configured in this manner, the developer positioned in the angular portions 211 (FIG. 2) in the boundary portions of the respective unit arc plates 241 where the transfer ribs 242 are absent undergoes a transfer function by the transfer ribs 242 in the next unit arc plate 241 owing to the rotations of the cartridge main body 21. Accordingly, no dead corner regarding the transportation of the developer is present on the inner side of the unit arc plates 241. The developer is thus transferred efficiently toward the developer discharging orifice 231.

Referring to FIG. 2 and FIG. 3 again, the shutter mechanism 25 that opens and closes the developer discharging orifice 231 provided to the right end wall 23 of the toner cartridge 20 will be described. The shutter mechanism 25 is formed by including three supporting legs 26 provided to protrude from the inner surface of the right end wall 23 and surround the developer discharging orifice 231, a triangular plate 27 installed among the tip ends (left ends) of these supporting legs 26, a shutter member 28 supported on the triangular plate 27, and a coil spring (pushing member) 29 that pushes the shutter member 28 toward the developer discharging orifice 231. The shutter member 28 and the coil spring 29 together form an opening and closing mechanism 280.

The respective supporting legs 26 are provided to protrude leftward in parallel to one another from the positions at which a distance from the center of the hole of the developer discharging orifice 231 at the base end portion (right end portion) to each supporting leg 26 is equal and distances among the adjacent supporting legs 26 are equal. Accordingly, a line linking the left end portions of the respective supporting legs 26 forms a regular triangle.

The triangular plate 27 is formed in the shape of a regular triangle correspondingly to the three supporting legs 26. The triangular plate 27 is attached to the right end wall 23 by fixing the tip ends of the respective supporting legs 26 at positions in the vicinity of the respective vertices. A through-hole is perforated in the triangular plate 27 at the center position and a guide tubular body 271 concentric with the through-hole is provided on the left surface side of the triangular plate 27.

The shutter member 28 includes a piston rod 281 fit into the guide tubular body 271 from the right surface side of the triangular plate 27 in a sliding contact state and the circular shutter 282 fixed concentrically to the right end portion of the piston rod 281. A diameter dimension of the circular shutter 282 is set to be almost the same as the diameter dimension of the flange 233*b* of the elastic tubular body 233.

The coil spring 29 is externally fit to the piston rod 281 in a compressed state between the circular shutter 282 and the triangular plate 27. Accordingly, until the toner cartridge 20 is attached to the accommodation portion 30, the circular shutter 282 is moved rightward by a pushing force of the coil spring 29 and pressed against the flange 233*b* of the elastic tubular body 233 in close adhesion. The developer discharging orifice 231 is thus kept closed, which makes it possible to prevent the developer inside the developer filling chamber V from leaking to the outside.

A plurality of scooping ribs (protrusions) 234 are provided on the inner surface side of the right end wall 23 of the toner cartridge 20 around the developer discharging orifice 231 in the circumferential direction at regular pitches. The scooping ribs 234 scoop up the developer accumulated in the bottom portion of the cartridge main body 21 in response to rotations of the cartridge main body 21 and force the developer toward a developer receiving and discharging orifice 521*a* (FIG. 8) described below. These scooping ribs 234 are set in such a manner that an amount of protrusion from the right end wall 23 to the left matches the developer receiving and discharging orifice 521*a*.

In a state where a remaining amount of the developer inside the cartridge main body 21 becomes small, the developer in the bottom portion of the cartridge main body 21 is scooped up by the scooping ribs 234 and discharged through the developer receiving and discharging orifice 521*a*. It is therefore possible to prevent the occurrence of an inconvenience that the toner cartridge 20 has to be replaced with a new one while a considerable amount of the developer remains inside.

FIG. 5A through FIG. 6F are views used to describe the Reuleaux triangle T adopted as the shape of the cartridge main body 21 when viewed in a cross section. FIG. 5A through FIG. 5F respectively show states where the reference vertex Q of the Reuleaux triangle T is rotated in a counterclockwise direction from the reference position W up to 150° by 30° at a time. FIG. 6A through FIG. 6F respectively show states where the reference vertex Q of the Reuleaux triangle T is rotated in a counterclockwise direction up to 330° by 30° at a time from the start point (FIG. 6A) rotated by 180° in a counterclockwise direction from the reference position. FIG. 6G shows a sub-elliptical shape formed by the circulation trajectory of the center of gravity, G, when the Reuleaux triangle T rotates inside a regular tetragon S.

Figure 5A:
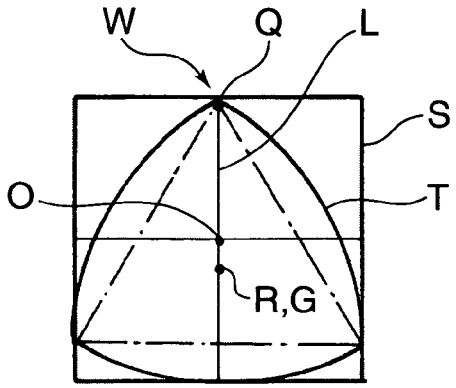
FIGS. 5A through 5F are views used to describe the Reuleaux triangle adopted as a shape of the cartridge main body when viewed in a cross section.
Figure 5B:
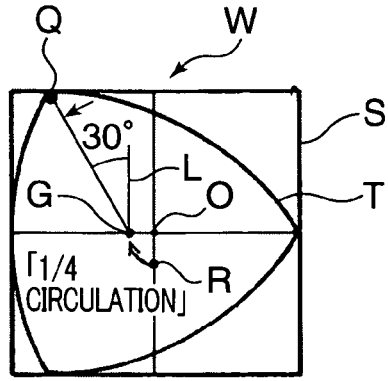
Figure 5C:
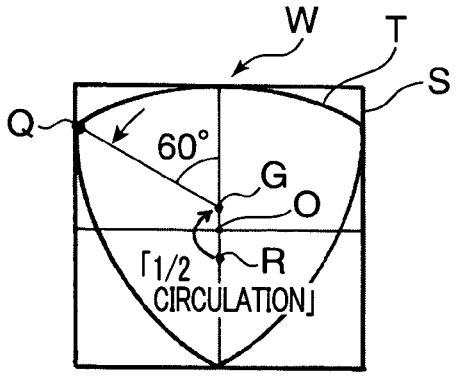
Figure 5D:
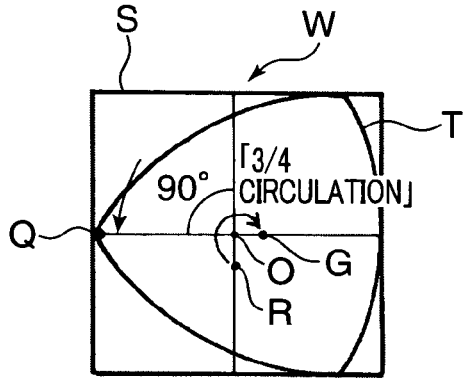
Figure 5E:
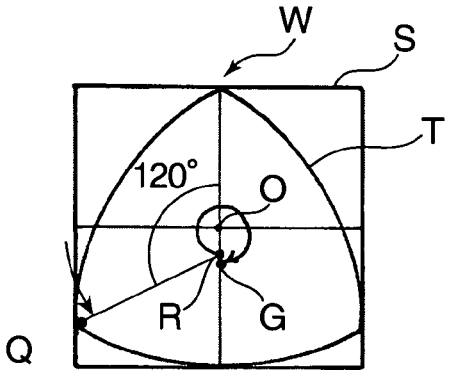
Figure 5F:
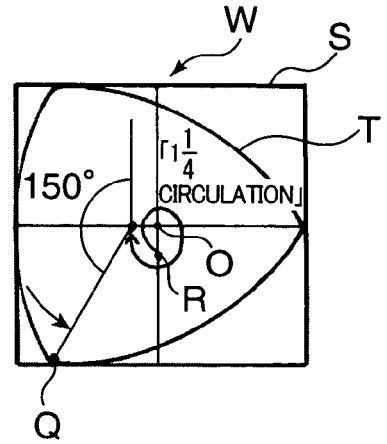

The Reuleaux triangle T is constructed by forming arcs corresponding to the respective sides centered at the respective vertices given a side length of a regular triangle indicated by an alternate and short dashed line in FIG. 5A as a radius. As are shown in FIG. 5A through FIG. 6F, the Reuleaux triangle T as above is allowed to rotate inside a regular tetragon S having aside length set to be equal to aside length of the regular triangle while the vertices and the arcs are coming into sliding contact with the respective sides of the regular tetragon.

Herein, given one of the vertices of the Reuleaux triangle T as the reference vertex Q, and as is shown in FIG. 5A, the reference vertex Q is first set at the mid-point position (reference position W) of a horizontal line at the top portion of the regular tetragon S. Subsequently, the Reuleaux triangle T is rotated in a counterclockwise direction by 30° at a time with respect to the vertical line L passing through the reference vertex Q. Then, as are shown in FIG. 5B through FIG. 6F, the center of gravity, G, of the Reuleaux triangle T circulates in a clockwise direction (that is, a direction opposite to the rotation direction of the Reuleaux triangle T) about the center O of the regular tetragon S by 90° at a time.

Accordingly, when the Reuleaux triangle T has rotated once in a counterclockwise direction inside the regular tetragon S from the state shown in FIG. 5A (returns to the state of FIG. 5A by changing to states shown in FIG. 5A through FIG. 6F), the center of gravity, G, of the Reuleaux triangle T has circulated three times in a clockwise direction about the center O of the regular tetragon S.

Incidentally, in FIG. 5B through FIG. 5F and FIG. 6A through FIG. 6F, the angle of rotation of the reference vertex Q of the Reuleaux triangle T from the reference position W is indicated by degrees and the number of circulations made by the center of gravity, G, of the Reuleaux triangle T is indicated by a figure in parentheses. In addition, the schematic trajectory of the center of gravity, G, is indicated by a spiral for ease of understanding of the number of circulations.

Figure 6A:
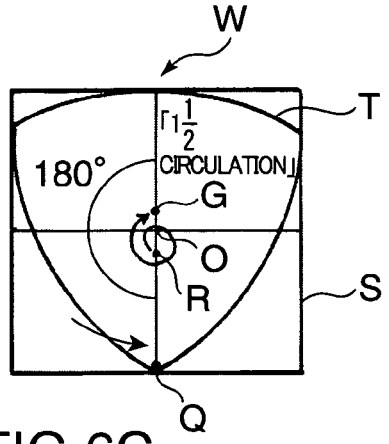
FIGS. 6A through 6F are views continued from FIG. 5 and used to describe the Reuleaux triangle adopted as the shape of the cartridge main body when viewed in a cross section.
Figure 6B:
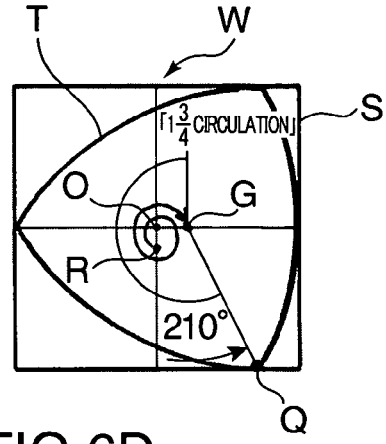
Figure 6C:
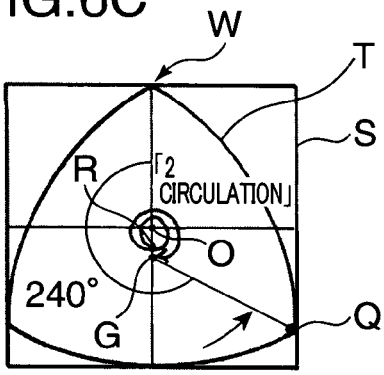
Figure 6D:
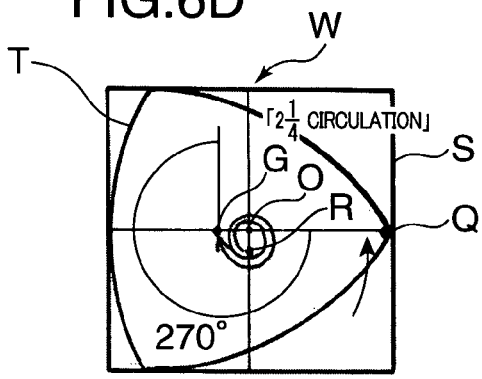
Figure 6E:
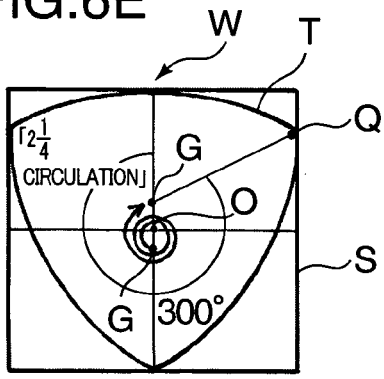
Figure 6F:
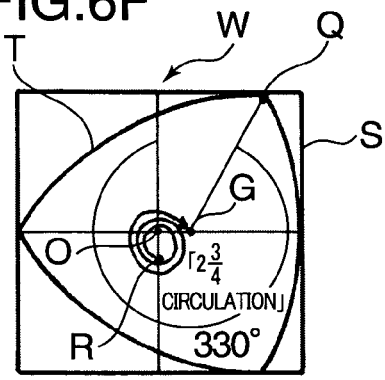
Figure 6G:
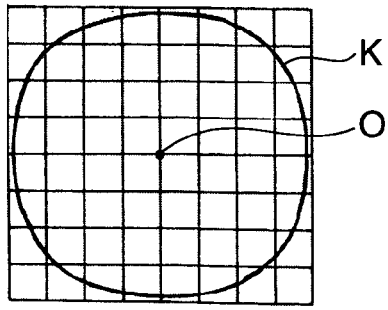

Incidentally, as is shown in FIG. 6G, the trajectory K of the center of gravity, G, of the Reuleaux triangle T when the Reuleaux triangle T has rotated inside the regular tetragon S is of a shape (sub-elliptical shape) in which four corners have a curvature radius smaller than that of an inscribed circle about the center O of the regular tetragon S and the four corners include a part of a predetermined elliptical shape.

In this embodiment, the Reuleaux triangle T showing behaviors as above inside the regular tetragon S is applied to the sectional shape of the toner cartridge 20 and the regular tetragon S is applied to the accommodation portion 30 in which the toner cartridge 20 is accommodated.

Figures 7A, 7B:
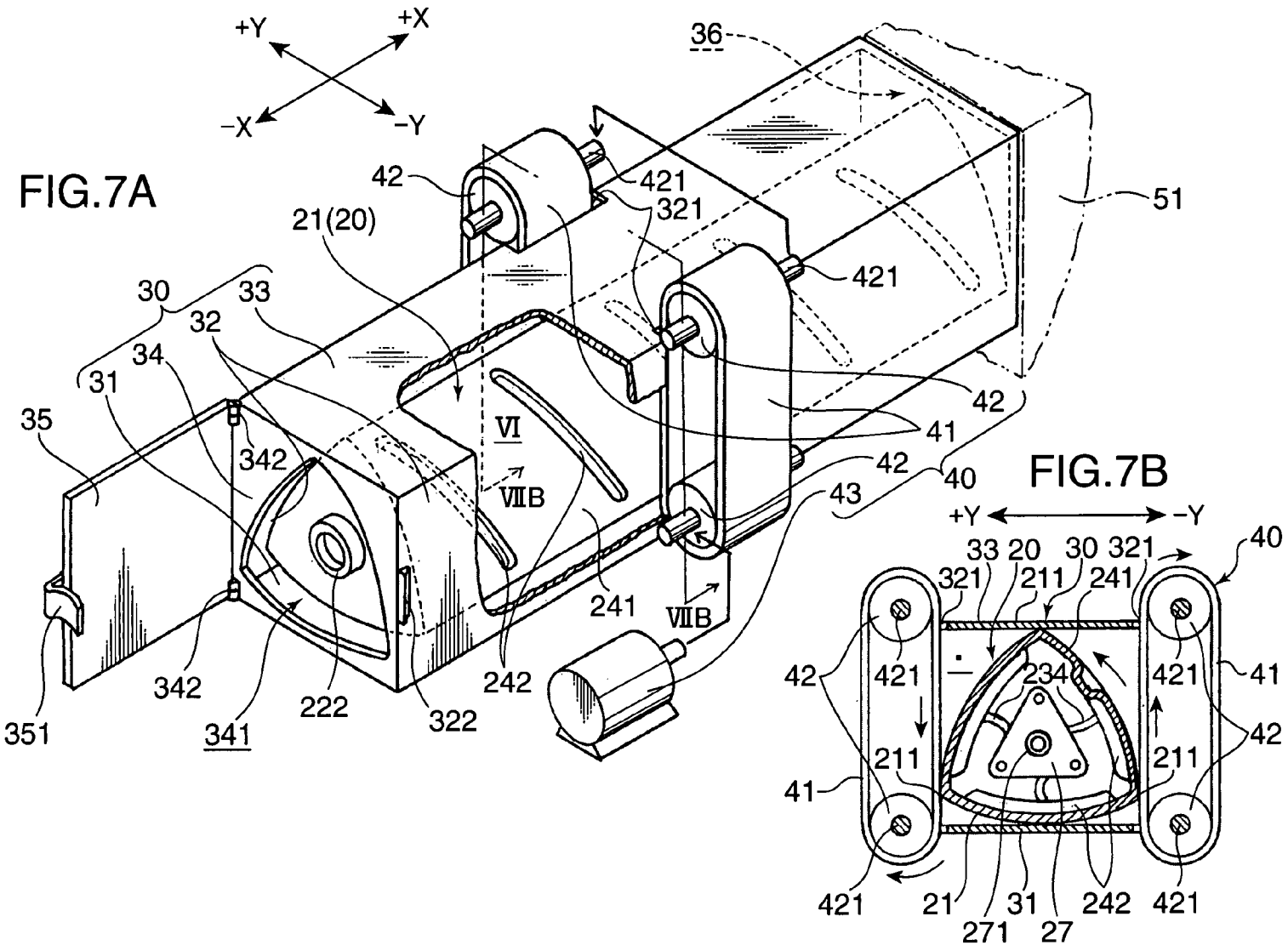
FIGS. 7A and 7B are views showing one embodiment of a rotation mechanism that rotates an angular tubular body and the toner cartridge inside the angular tubular body.

FIGS. 7A and 7*b* are views showing one embodiment of the accommodation portion 30 and a rotation mechanism 40 that rotates the toner cartridge 20 inside the accommodation portion 30. FIG. 7A is a perspective view and FIG. 7B is a cross section taken on line VIIB-VIIB of FIG. 7A. Indications of direction in FIG. 7 using letters X and Y are the same as in FIG. 1 (X is the right-left direction (−X: leftward, +X: rightward) and Y is the front-rear direction (−Y: frontward, +Y: rearward)).

As are shown in FIGS. 7A and 7B, the accommodation portion 30 corresponds to the regular tetragon S (FIG. 5) that wraps and holds the Reuleaux triangle T described above. It is in the shape of a square prism long in the right-left direction in a state where it includes an inner surface with which the outer peripheral surface of the barrel 24 of the cartridge main body 21 comes into sliding contact and the cross section of the inner surface in a direction orthogonal to a direction of the tube center line is set to be of the shape of a regular tetragon. The toner cartridge 20 is attached inside the accommodation portion 30 configured as above in a sliding contact state.

The accommodation portion 30 includes a rectangular bottom plate 31, a pair of side plates 32 provided to the bottom plate 31 so as to stand from the front and rear edge portions thereof, a top plate 33 provided to bridge between the upper edge portions of a pair of these side plates 32, and a left surface plate 34 installed among the respective left edge portions of the bottom plate 31, a pair of the side plates 32, and the top plate 33. A cartridge attachment chamber V1 in which to attach the toner cartridge 20 is defined by a space surrounded by the bottom plate 31, a pair of the side plates 32, and the left side plate 34. Incidentally, the right surface of the accommodation portion 30 is an open end (right surface opening 36).

The inner dimensions on the short side of the bottom plate 31, a pair of the side plates 32, and the top plate 33 (the dimension on the interior side of the accommodation portion 30 when the accommodation portion 30 is formed) are set to be the same as the outer dimension of the cartridge main body 21 among the angular portions 211 when viewed in a cross section. Consequently, as are shown in FIG. 5 and FIG. 6, the toner cartridge 20 comes into sliding contact with the inner wall surface of the accommodation portion 30 at the respective angular portions 211 and the arc surface of one unit arc plate 241. It should be noted that the angular portions 211 are not allowed to come into sliding contact with the inner wall surface of the accommodation portion 30 only when they oppose the corner portions of the accommodation portion 30.

A notch window 321 extending along the full length in the top-bottom direction at a predetermined width is formed to each side plate 32 at the center position in the right-left direction. These notch windows 321 are provided so that drive belts 41 of the rotation mechanism 40 described below are fit therein.

The left surface plate 34 is provided with a cartridge attachment opening (attaching and detaching opening) 341 of a similar shape with the sectional shape of the toner cartridge 20 (the shape of the Reuleaux triangle T shown in FIG. 5) and slightly larger than the cross section. The toner cartridge 20 is inserted into and pulled out from the accommodation portion 30 through the cartridge attachment opening 341.

A lid 35 is attached to the left surface plate 34 as above in a pivotal manner about a hinge 342 provided to the rear edge portion. A stopping member 351 formed of, for example, a spring material, is provided to the lid portion 35 in the edge portion on the tip end side whereas a stopping protrusion 322 corresponding to the stopping member 351 is provided to the side plate 32 on the front side in the left edge portion on the outer surface side.

Accordingly, the stopping member 351 engages with the stopping protrusion 322 in a state where the lid 35 is closed, which makes it possible to maintain the cartridge attachment opening 341 of the accommodation portion 30 in a state closed by the lid 35. By closing the cartridge attachment opening 341 with the lid 35, it becomes possible to prevent the toner cartridge 20 attached inside the accommodation portion 30 from protruding to the outside from the cartridge attachment opening 341.

The rotation mechanism 40 rotates the toner cartridge 20 attached inside the accommodation portion 30. The rotation mechanism 40 is formed by including a pair of drive belts 41 on front and rear, a pair of rollers 42 at top and bottom over which each drive belt 41 is looped, and a drive motor 43 that provides a drive force to these rollers 42. Parts of the drive belts 41 are fit into the corresponding notch windows 321 formed in the respective side plates 32 of the accommodation portion 30 in the top-down direction.

As is shown in FIG. 7B, the respective roller shafts 421 of each pair of the rollers 42 at top and bottom are set at almost the same level in height with the upper and lower end portions of the notch windows 321. Each drive belt 41 is thus brought into a state where it slightly comes inside the cartridge attachment chamber V1 from the inner surface of the corresponding side plate 32 on one side almost along the full length. Hence, while the toner cartridge 20 is attached inside the cartridge attachment chamber V1 of the accommodation portion 30, the angular portions 211 or the arc surfaces of the unit arc plates 241 of the toner cartridge 20 are in a state where they never fail to abut on the drive belts 41.

A drive force of the drive motor 43 is transmitted to any of the roller shafts 421 via an unillustrated first gear mechanism, and a circulation force of one of the drive belts 41 to which is transmitted the drive force of the drive motor is transmitted to the other drive belt 41 via an unillustrated second gear mechanism. Consequently, a pair of the drive belts 41 circulates in synchronization while the opposing surfaces are headed in the opposite directions.

Incidentally, in this embodiment, as is shown in FIG. 7B, the drive belt 41 on the front side is circulated in a clockwise direction and the drive belt 41 on the rear side is also circulated in a clockwise direction. Owing to the circulations of these drive belts 41, the toner cartridge 20 abutting on the drive belts 41 at the angular portions 211 or the arc surfaces of the unit arc plates 241 is rotated in a counterclockwise direction.

When the toner cartridge 20 is attached inside the accommodation portion 30 and rotated by the driving of the rotation mechanism 40, the developer inside the developer filling chamber V of the toner cartridge 20 is stirred. Moreover, the developer is transported toward the developer discharging orifice 231 while being guided by a plurality of the transfer ribs 242 formed on the respective unit arc plates 241 of the cartridge main body 21, and eventually replenished to the developing device 134 via a transportation mechanism 50 provided to the apparatus main body 11 of the printer 10.

Figure 9A:
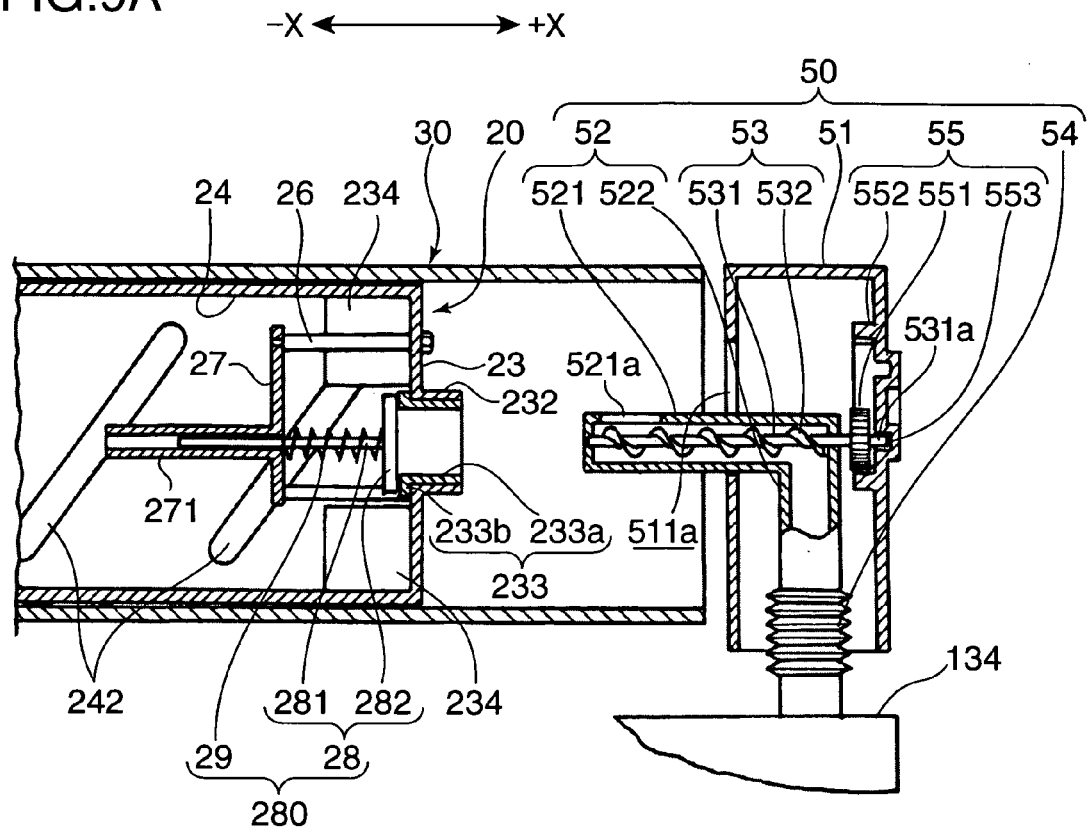
FIGS. 9A and 9B are cross sections taken online IX-IX of FIG. 8.
Figure 9B:
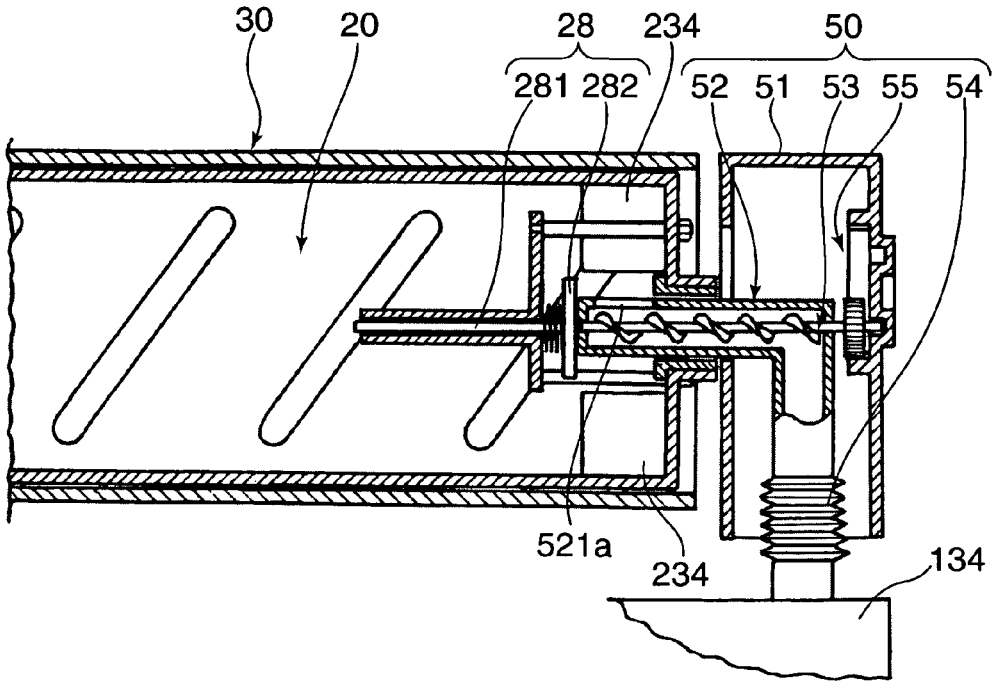

An amount of protrusion of the scooping ribs 234 to the left from the right end wall 23 of the cartridge main body 21 is set in such a manner that each protrudes as far as or farther the left end position of the developer receiving and discharging orifice 521*a* in a state where the toner cartridge 20 is connected to a developer receiving and discharging pipe 52 (see FIG. 9B). Accordingly, even when a remaining amount of the developer inside the toner cartridge 20 becomes small, the scooping ribs 234 scoop up the developer in response to rotations of the toner cartridge 20 and force the developer toward the developer receiving and discharging orifice 521*a*. This configuration makes it possible to prevent the occurrence of an inconvenience that the developer that cannot be discharged remains inside the toner cartridge 20.

Figure 8:
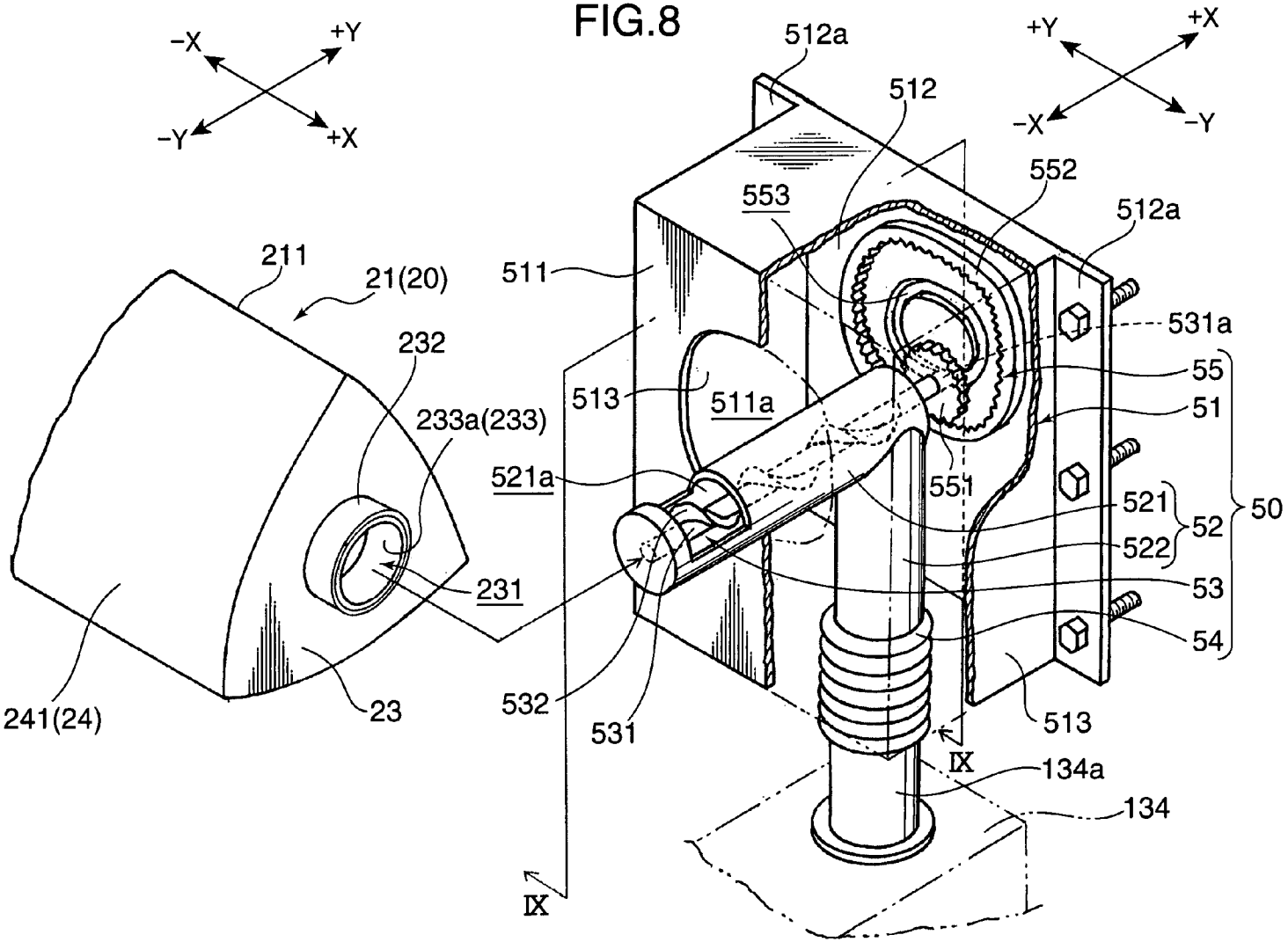
FIG. 8 is a partially notched perspective view showing one embodiment of a transportation mechanism.

Hereinafter, the transportation mechanism 50 will be described on the basis of FIG. 8 and FIGS. 9A, 9B showing the transportation mechanism 50. FIG. 8 and FIGS. 9A, 9B are views showing one embodiment of the transportation mechanism 50. FIG. 8 is a partially notched perspective view. FIGS. 9A, 9B are cross sections taken on line IX-IX of FIG. 8. FIG. 9A shows a state before the toner cartridge 20 is coupled to the transportation mechanism 50. FIG. 9B shows a state where the toner cartridge 20 is coupled to the transportation mechanism 50. For ease of illustration, a guide window 511*a*, an internal gear 552, and an annular groove 553 in FIG. 8 are more exaggerated than the actual ones. In addition, FIG. 9 shows the accommodation portion 30 together. Indications of direction in FIG. 8 and FIGS. 9A, 9B using letters X and Y are the same as in FIG. 1 (X is the right-left direction (−X: leftward, +X: rightward) and Y is the front-rear direction (−Y: frontward, +Y: rearward)).

As is shown in FIG. 8, the transportation mechanism 50 includes a frame body 51 in the shape of a square prism fixed to a predetermined frame inside the apparatus main body 11 of the printer 10, a developer receiving and discharging pipe 52 connected to the toner cartridge 20 in a state where it is internally attached to the frame body 51 with a part thereof protruding to the outside, a spiral feeder 53 internally attached to the developer receiving and discharging pipe 52, a flexible pipe 54 interposed between the developer receiving and discharging pipe 52 and the developing device 134, and a gear mechanism 55 that forces the developer receiving and discharging pipe 52 to circulate in response to rotations of the toner cartridge 20.

As is shown in FIGS. 9A and 9B, the frame body 51 is provided at a position opposing a right end opening of the accommodation portion 30. The frame body 51 is formed of a left surface plate 511 opposing the right surface opening 36 of the accommodation portion 30, a right surface plate 512 opposing the left surface plate 511 on the right, and a pair of side plates 513 in the front-rear direction provided to bridge between the edge portions on front and rear of these left surface plate 511 and right surface plate 512. Brackets 512*a* long in the top-bottom direction are provided to the right surface plate 512 so as to protrude in the opposite directions from the edge portions on front and rear. For example, by bolting these brackets 512*a* to an unillustrated frame, the transportation mechanism 50 is fixed at a predetermined position inside the apparatus main body 11 (at a position opposing the accommodation portion 30).

A guide window 511*a* that guides circulation movements of the developer receiving and discharging pipe 52 is provided to the left surface plate 511. The shape of the guide window 511*a* is set to a sub-elliptical shape so that the peripheral edge is along an envelope formed by circulations of a transverse pipe 521 (element forming the development agent receiving and discharging pipe 52) described below in response to circulations of the coupling cylinder 232 inside the accommodation portion 30.

The developer receiving and discharging pipe 52 is formed of the transverse pipe 521 whose left side portion protrudes from inside the frame body 51 to the outside through the guide window 511*a* and a longitudinal pipe 522 provided to extend downward from the right end position of the transverse pipe 521.

Almost a half of the transverse pipe 521 in the longitudinal direction is accommodated in the frame body 51, whereas the other half protrudes to the outside from the guide window 511*a*. The major diameter dimension of the transverse pipe 521 is set to be almost the same as the minor diameter dimension of the developer discharging orifice 231 of the cartridge main body 21 (that is, the minor diameter dimension of the cylinder main body 233*a* of the elastic circular tubular body 233). This configuration allows the coupling cylinder 232 to be externally fit to the transverse pipe 521 in a sliding contact state.

The transverse pipe 521 is provided with the developer receiving and discharging orifice 521*a* formed by notching the upper half of the left end portion. The position to provide the developer receiving and discharging orifice 521*a* is set so that it positions inside the developer filling chamber V of the cartridge main body 21 beyond the coupling cylinder 232 in a state where the coupling cylinder 232 is externally fit to the transverse pipe 521.

A length dimension of the transverse pipe 521 is set so that the left end surface does not reach the triangular plate 27 via the circular shutter 282 in a state where the coupling cylinder 232 is externally fit thereto. As is shown in FIG. 9A, immediately before the toner cartridge 20 is attached to the accommodation portion 30 completely, the circular shutter 282 is kept pushed rightward by a pushing force of the coil spring 29. The developer discharging orifice 231 is thus maintained in a closed state.

By pushing the toner cartridge 20 all the way into the accommodation portion 30 in this state, as is shown in FIG. 9B, the transverse pipe 521 is fit in the coupling cylinder 232 and presses the circular shutter 282 leftward relatively against the pushing force of the coil spring 29. The resulting leftward movement of the circular shutter 282 not only opens the developer discharging orifice 231 but also brings the developer receiving and discharging orifice 521*a* of the transverse pipe 521 in a state where it positions inside the cartridge main body 21.

When the circular shutter 282 is pressed by the transverse pipe 521 relatively and moves inward in the cartridge main body 21, the developer positioned in the vicinity of the circular shutter 282 is pressed by the circular shutter 282 and loosened. Accordingly, even when lumps of the developer are formed in this portion, the lumps are pulverized.

Hence, when the toner cartridge 20 inside the accommodation portion 30 rotates in this state, the developer scooped upward is introduced smoothly into the transverse pipe 521 via the developer receiving and discharging orifice 521*a*. Thereafter, the developer is replenished to the developing device 134 via the longitudinal pipe 522, the flexible pipe 54, and a developer accepting pipe 134*a* by the driving of the spiral feeder 53.

In this embodiment, when rotations of the toner cartridge 20 via the drive belts 41 by the driving of the drive motor 43 (FIGS. 7A, 7*b*) described below are stopped, the driving of the drive motor 43 is controlled in such a manner that the center of gravity of the Reuleaux triangle of the toner cartridge 20 positions at the lowermost position. By applying the control in this manner, it becomes possible to bring the transverse pipe 521 fit in the coupling cylinder 232 of the toner cartridge 20 into a state where it positions at the lowermost position always when the toner cartridge 20 is attached to or detached from the accommodation portion 30. Hence, by inserting the toner cartridge 20 into the cartridge attachment chamber V1 through the cartridge attachment opening 341 (FIGS. 7A, 7B), the coupling cylinder 232 is allowed to be externally fit to the transverse pipe 521.

The spiral feeder 53 is internally attached to the transverse pipe 521 concentrically in a rotatable manner about the shaft center. The spiral feeder 53 is formed of a feeder shaft 531 installed between the left end wall and the right end wall of the transverse pipe 521 and a spiral fin 532 provided around the feeder shaft 531 concentrically. Regarding the feeder shaft 531, the left end portion is supported at the center position of the left end wall of the transverse pipe 521 without penetrating through the left end wall whereas the right end portion protrudes to the outside by penetrating through the center position of the right end wall of the transverse pipe 521. A circulation gear 551 described below is externally fit to the feeder shaft 531 in this portion protruding to the outside concentrically in an integrally rotatable manner.

The flexible pipe 54 addresses the circulation movements of the developer receiving and discharging pipe 52 along the peripheral edge of the guide window 511*a* and includes a bellows portion. The flexible pipe 54 is interposed between the upper end portion of the developer accepting pipe 134*a* provided to protrude upward from the top of the developer 134 and the lower end portion of the longitudinal pipe 522 and it expands and contracts in response to the circulation movements of the developer receiving and discharging pipe 52.

The gear mechanism 55 transmits the circulation movements of the developer receiving and discharging pipe 52 after it converts the circulation movements to rotations about the shaft center of the spiral feeder 53. The gear mechanism 55 includes the circulation gear 551 provided to be externally fit to the right end portion of the feeder shaft 531 concentrically in an integrally rotatable manner, the internal gear 552 fixed to the left surface of the right surface plate 512 of the frame body 51 and having internal teeth to be meshed with the circulation gear 551 on the inner peripheral surface, and the annular groove 553 to guide the right end portion 531*a* of the feeder shaft 531 that is provided concentrically in a concave shape on the inner side of the internal gear 552 in the right surface plate 512.

In this embodiment, the circulation gear 551 is set to have a diameter dimension almost the same as the major diameter dimension of the transverse pipe 521. An inner peripheral edge of the internal gear 552 is set to be of a sub-elliptical shape same as that of the inner peripheral edge of the guide window 511*a* (that is, the envelope of the circulation movements of the transverse pipe 521). The annular groove 553 is set to be of a sub-elliptical shape so that it goes along the trajectory of circulation movements of the position of the center of gravity of the cartridge main body 21. For ease of illustration, the internal gear 552 and the annular groove 553 are shown considerably large in FIG. 8.

According to the gear mechanism 55 configured in this manner, when the coupling cylinder 232 of the cartridge main body 21 circulates in the opposite direction about the center line of the accommodation portion 30 as the toner cartridge 20 rotates inside the accommodation portion 30, the circulation movements are transmitted to the transverse pipe 521 of the developer receiving and discharging pipe 52 internally fit to the coupling cylinder 232. The transverse pipe 521 therefore starts to circulate inside the guide window 511*a* while being guided by both the peripheral edge of the guide window 511*a* and the annular groove 553 in which the right end portion 531*a* of the feeder shaft 531 is fit.

When the transverse pipe 521 circulates, so does the circulation gear 551 that is integral with the feeder shaft 531 meshed with the internal teeth of the internal gear 552 along the internal teeth of the internal gear 552 with which the circulation gear 551 is meshed. These circulations allow the spiral feeder 53 to rotate integrally about the feeder shaft 531. Owing to the rotations of the developer receiving and discharging pipe 52, the developer discharged into the transverse pipe 521 through the developer receiving and discharging orifice 521*a* is transported toward the longitudinal pipe 522 and replenished to the developing device 134 via the flexible pipe 54 and the developer accepting pipe 134*a*.

Figure 10A:
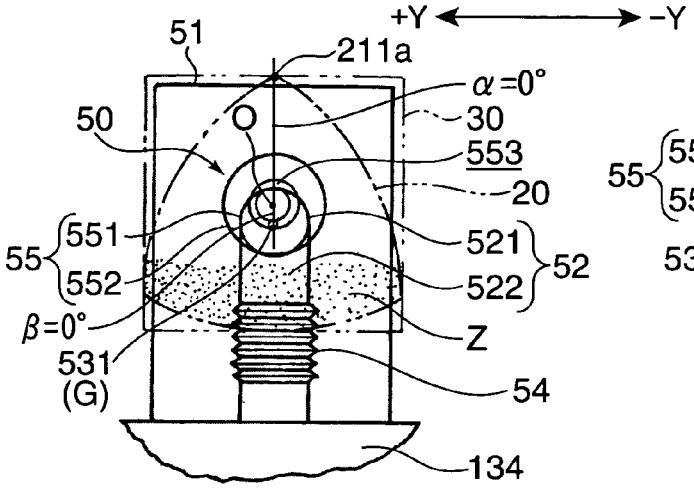
FIGS. 10A through 10E are schematic views of the transportation mechanism when viewed from the left and used to describe the function of the transportation mechanism by focusing a relation of rotations of the toner cartridge and circulations of a developer receiving and discharging pipe in a state where the toner cartridge is attached to the angular tubular body.
Figure 10B:
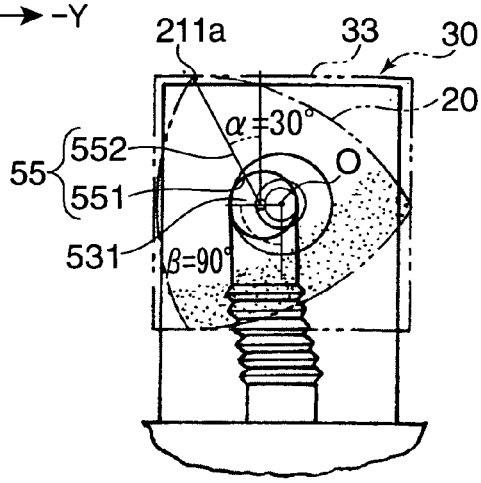
Figure 10C:
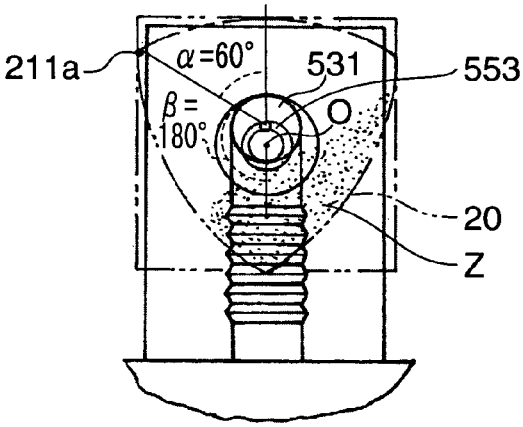
Figure 10D:
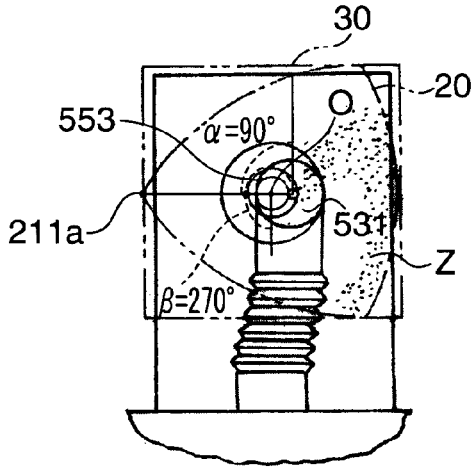
Figure 10E:
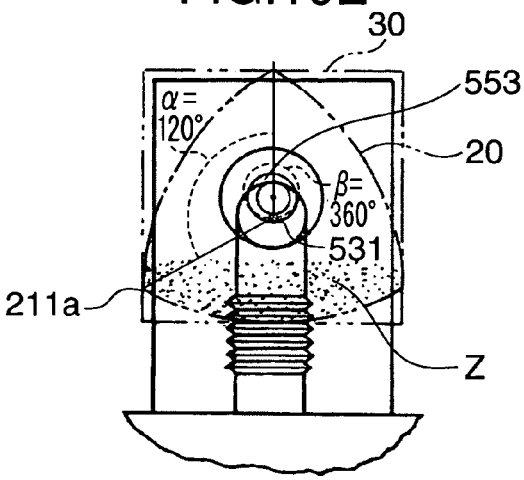

FIGS. 10A through 10E are views used to describe the function of the transportation mechanism 50 by focusing a relation between the rotations of the toner cartridge 20 and the circulations of the developer receiving and discharging pipe 52 in a state where the toner cartridge 20 is attached to the accommodation portion 30, and they are schematic explanatory views when the transportation mechanism 50 is viewed from the left. FIG. 10A shows a state where the toner cartridge 20 is set at the reference position. FIG. 10B shows a state where the toner cartridge 20 is rotated by 30° in a counterclockwise direction from the reference position. FIG. 10C shows a state where the toner cartridge 20 is rotated by 60°. FIG. 10D shows a state where the toner cartridge 20 is rotated by 90°. FIG. 10E shows a state where the toner cartridge 20 is rotated by 120°.

In FIGS. 10A through 10E, the internal gear 552 and the annular groove 553 of a sub-elliptical shape are indicated by circles for ease of illustration. Also, in FIGS. 10A through 10E, the angle of rotation of the toner cartridge 20 is indicated by $\alpha$ and the angle of circulation of the feeder shaft 531 is indicated by $\beta$. Further, indications of direction in FIGS. 10A through 10E using a letter Y are the same as in FIG. 1 (−Y: frontward, +Y: rearward).

As is shown in FIG. 10A, in a state where the toner cartridge 20 is set at the reference position immediately after it is attached to the accommodation portion 30, the reference angular portion 211*a* of the toner cartridge 20 is positioned directly above the center O of the accommodation portion 30. Also, the feeder shaft 531 guided by the annular groove 553 (that is, the center of gravity, G, of the toner cartridge 20) is positioned directly below the center O of the accommodation portion 30.

When the toner cartridge 20 in this state rotates by 30° ($\alpha$=30°) in a counterclockwise direction by the driving of the rotation mechanism 40 (FIGS. 7A, 7B) as is shown in FIG. 10B, the reference angular portion 211*a* of the toner cartridge 20 is brought into a state where it is positioned in the vicinity of the rear end position of the top plate 33 of the accommodation portion 30. In addition, the feeder shaft 531 circulates by 90°($\beta$=90°) in a clockwise direction about the center O of the accommodation portion 30 while being guided by the annular groove 553.

This circulation of the feeder shaft 531 forces the circulation gear 551 not only to circulate (revolve) by 90° about the center O of the accommodation portion 30 but also to rotate (rotate on its axis) about feeder shaft 531 in a counterclockwise direction. Owing to the rotations of the feeder shaft 531, the developer discharged into the transverse pipe 521 from the toner cartridge 20 is guided by the spiral fin 532 (FIG. 8) that integrally rotates with the feeder shaft 531 of the spiral feeder 53 and replenished to the developing device 134 by passing through the longitudinal pipe 522 and the flexible pipe 54. The mechanism of replenishment of the developer to the developing device 134 by the driving of the spiral feeder 53 is the same in the following FIG. 10B through FIG. 10E.

Subsequently, as is shown in FIG. 10C, when the toner cartridge 20 rotates by 60° ($\alpha$=60°) in a counterclockwise direction, the reference angular portion 211*a* of the toner cartridge 20 is brought into a state where it is positioned in the vicinity of the upper end position of the side plate 32 of the accommodation portion 30 on the rear side. Also, the feeder shaft 531 circulates by 180° ($\beta$=180°) in a clockwise direction about the center O of the accommodation portion 30 while being guided by the annular groove 553.

This circulation forces the transverse pipe 521 to position at the maximum height position directly above the center O of the accommodation portion 30 and forces the flexible pipe 54 to be in a state where it is expanded to the maximum length.

Subsequently, as is shown in FIG. 10D, when the toner cartridge 20 rotates by 90° ($\alpha$=90°) in a counterclockwise direction, the reference angular portion 211*a* of the toner cartridge 20 is brought into a state where it positions in the center portion in the top-bottom direction of the side plate 32 of the accommodation portion 30 on the rear side. Also, the feeder shaft 531 circulates by 270° ($\beta$=270°) in a clockwise direction about the center O of the accommodation portion 30 while being guided by the annular groove 553. This circulation brings the transverse pipe 521 into a state where it positions directly in front of the center O of the accommodation portion 30.

Further, as is shown in FIG. 10E, when the toner cartridge 20 rotates by 120° ($\alpha$=120°) in a counterclockwise direction, the reference angular portion 211*a* of the toner cartridge 20 is brought into a state where it positions slightly above the lower end of the side plate 32 of the accommodation portion 30 on the rear side. Also, the feeder shaft 531 circulates by 360° ($\beta$=360°) in a clockwise direction about the center O of the accommodation portion 30 while being guided by the annular groove 553. This circulation brings the transverse pipe 521 into a state where it positions at the lowermost position (the position same as the position shown in FIG. 10A).

As the toner cartridge 20 rotates in a counterclockwise direction inside the accommodation portion 30 in this manner, the circulation gear 551 correspondingly rotates on its axis in a counterclockwise direction about the feeder shaft 531 while revolving in a clockwise direction about the center O of the accommodation portion 30 by an angle of rotation ($\beta=3\alpha$) three times larger than the angle of rotation of the toner cartridge 20. Accordingly, the spiral feeder 53 (FIG. 8) integral with the circulation gear 551 starts to rotate in the same direction by rotating on its axis. The developer discharged from the toner cartridge 20 and received by the transverse pipe 521 is thus sent always appropriately toward the developing device 134.

Subsequently, behaviors of the developer Z filled in the toner cartridge 20 with the rotations of the toner cartridge 20 will now be described. In a case where the developer Z in an amount at least a half of the volume of the toner cartridge 20 is filled in the toner cartridge 20, the developer Z in the vicinity of the center of gravity, G, inside the toner cartridge 20 rotates in the opposite direction at a rotation rate three times higher than a rotation rate of the toner cartridge 20. Consequently, it becomes possible to achieve the most noticeable function and effect of this embodiment, that is, forces heading in opposite directions in the circumferential direction are applied respectively to the developer Z in the vicinity of the center of gravity, G, and the developer Z around this developer Z, so that the developer Z is stirred effectively in the center portion of the toner cartridge 20.

Behaviors of the developer Z when an amount of the developer Z in the toner cartridge 20 becomes small will be described on the basis of FIG. 10A through FIG. 10E. In FIG. 10A through FIG. 10E, the developer Z is indicated by dots, and these drawings show a state where a small amount (about ¼ of the volume) of the developer Z is filled in the toner cartridge 20 for ease of description.

As is shown in FIG. 10A, when the toner cartridge 20 is driven to rotate by defining a state where it is set at the reference position as the start point, the developer Z is first in a state where it is accumulated at the bottom of the toner cartridge 20 almost in the same thickness. When the toner cartridge 20 is rotated in a counterclockwise direction in this state, as is shown in FIG. 10B, the angle of inclination of the bottom portion of the toner cartridge 20 with respect to the horizontal plane is not significantly large until the angle of rotation reaches 30° (30° is an average angle of inclination of the bottom portion of the toner cartridge 20 when the angle of rotation reaches 30°). The developer Z therefore migrates in a state where the thickness does not vary considerably.

Subsequently, when the toner cartridge 20 is rotated by another 30° to 60° as is shown in FIG. 10C, the bottom portion of the toner cartridge 20 inclines by 60° with respect to the horizontal plane. This steep inclination makes it easy for the developer Z to slide downward. Hence, the developer Z slides down in part and is accumulated thickly at the lower portion inside the toner cartridge portion 20.

Subsequently, when the toner cartridge 20 rotates by 90° from the reference position, the portion that previously formed the bottom portion of the toner cartridge 20 abruptly produces 90° with respect to the horizontal plane and forms a steep wall surface rather than an inclined surface. Accordingly, as is shown in FIG. 10D, the developer Z is thrown off from the wall surface. When the toner cartridge rotates further by 120°, as is shown in FIG. 10E, the developer newly accumulates at the bottom of the toner cartridge 20.

When the toner cartridge 20 set to be of the shape of the Reuleaux triangle when viewed in a cross section rotates inside the accommodation portion 30 in this manner, there is a point of displacement at which a direction of a force acting on the developer Z filled in the toner cartridge 20 varies abruptly for every 30°. Hence, in comparison with a related art where the developer is stirred inside the circular tubular body that is rotating about the tube center, it becomes possible to enhance the stirring effect of the developer Z markedly.

In addition, in this embodiment, the scooping ribs 234 that scoop up the developer are provided on the inner surface of the right side wall 23 of the cartridge main body 21, and the scooping ribs 234 scoop up the developer toward the developer receiving and discharging orifice 521*a* in response to rotations of the cartridge main body 21. Accordingly, owing to the function of the scooping ribs 234, too, not only is it possible to apply a stirring process to the developer, but it is also possible to prevent the developer from remaining inside the toner cartridge 20.

As has been described in detail, the toner cartridge 20 of this embodiment has the cartridge main body 21 as a container filled with the developer and the shutter mechanism 25 that opens and closes the developer discharging orifice 231 formed in the cartridge main body 21. The cartridge main body 21 has a pair of the mutually opposing end walls (left end wall 22 and right end wall 23) and the barrel 24 installed between a pair of these end walls 22 and 23. A cross section of the barrel 24 orthogonal to the direction of the tube center line is set to be of the shape of the Reuleaux triangle.

When the toner cartridge 20 is configured in this manner, it is possible to replenish the developer in the cartridge main body 21 to the developer 134 by opening the developer discharging orifice 231 provided to the cartridge main body 21 by activating the shutter mechanism 25 while the cartridge main body 21 filled with the developer inside is attached to the apparatus main body 11 of the printer 10.

Also, a shape of the cross section of the barrel 24 of the cartridge main body 21 orthogonal to the direction of the tube center line is set to the shape of the Reuleaux triangle. By rotating the barrel 24 within a predetermined frame formed of a regular tetragon having a side equal to the radius curvature of an arc centered at any vertex of the Reuleaux triangle, the position of the center of gravity of the Reuleaux triangle circulates three times as many as the number of rotations of the barrel 24 (incidentally, five times in a case where the Reuleaux polygon is a pentagon and seven times in a case where the Reuleaux polygon is a heptagon) in an opposite rotation direction.

Accordingly, regarding the developer inside the barrel 24, by rotating the barrel 24 of the cartridge main body 21 within the square frame, forces heading toward opposite directions respectively act on the developer in the vicinity of the position of the center of gravity and the developer around this developer. Because the developer is loosened by these forces, the developer in the toner cartridge 20 is stirred in a more reliable manner than in the related art where the toner cartridge 20 is formed of a circular tube (in the case of a circular tube, the position of the center of gravity does not circulate).

In addition, by rotating the barrel 24 of the cartridge main body 21 inside the square frame, a direction of the force applied to the developer filled in the barrel 24 varies abruptly for each rotation by a predetermined angle corresponding to the number of angles of the barrel 24 (that is, a point of displacement is present). In this regard, too, the developer in the toner cartridge 20 of this embodiment can be stirred in a more reliable manner than in the case of a conventional circular tubular toner cartridge in which a point of displacement is absent.

When the toner cartridge 20 has been stored over a long period, for example, in a vertical posture, the developer may possibly be hardened to form lumps at the lower portion inside the cartridge main body 21 in a vertical posture. Even in this case, the lumps can be readily pulverized by a stirring force developed with high-speed rotations of the developer at the position of the center of gravity or an abrupt change in direction of a force applied to the developer caused by rotating the barrel 24 of the cartridge main body 21. It thus becomes possible to prevent the occurrence of inconveniences that the developer is not replenished smoothly from the toner cartridge 20 to the developing device 134 or the toner cartridge 20 has to be replaced with a new one even when a considerable amount of developer remains inside because of the presence of the lumps.

The developer discharging orifice 231 is provided at the position of the center of gravity of the Reuleaux polygon on one side of a pair of the end walls. It is therefore possible to use the circulations of the developer discharging orifice 231 about the center of gravity in response to the rotations of the barrel 24 of the cartridge main body 21 inside the accommodation portion 30 as the drive source of the spiral feeder 53 that transports the developer introduced and discharged through the developer discharging orifice 231 to the developing device. Accordingly, the need to provide an exclusive-use drive source to drive the transportation member can be eliminated, and this elimination of the need can contribute to simplification of the apparatus, a reduction of the number of components, and a reduction of the manufacturing costs.

The shutter mechanism 25 includes the shutter member 28 provided with the circular shutter 282 that closes the developer discharging orifice 231 in a re-openable manner from inside the cartridge main body 21 and the coil spring 29 that biases the circular shutter 282 toward the developer discharging orifice 231. The developer discharging orifice 231 is normally in a closed state because the circular shutter 282 is kept pushed from inside the cartridge main body 21 by a pushing force of the coil spring 29. Meanwhile, the developer discharging orifice 231 is opened by pressing the circular shutter 282 from outside the cartridge main body 21 against the pushing force of the coil spring 29. According to this configuration, it becomes possible to make the structure of the shutter structure 25 simpler on one hand and facilitate the opening and closing operation of the circular shutter 282 on the other hand.

The scooping ribs 234 are provided to the right end wall 23 of the cartridge main body 21 so as to protrude inward in the cartridge main body 21. Accordingly, the developer at the bottom portion of the cartridge main body 21 is scooped up by the scooping ribs 234 in a state where a remaining amount of the developer in the cartridge main body 21 becomes small and discharged through the developer receiving and discharging orifice 521*a*. It thus becomes possible to prevent the occurrence of an inconvenience that the toner cartridge 20 has to be replaced with a new one even when a considerable amount of the developer remains inside.

A plurality of the transfer ribs 242 are provided on the inner peripheral surface of the barrel 24 so as to protrude inward. By rotating the barrel of the cartridge main body 21 inside the square frame, the developer positioned on the inner peripheral surface of the barrel in the cartridge main body 21 is stirred by the transfer ribs 242 provided to the inner peripheral surface so as to protrude. It thus becomes possible to stir the developer in the barrel 24 effectively across the full length of the barrel 24.

Further, this embodiment adopts, as the sectional shape of the barrel 24 of the cartridge main body 21, the Reuleaux triangle, which has the largest amount of movement of the center of gravity among the Reuleaux polygons. It thus becomes possible to achieve an excellent stirring effect for the developer filled inside in association with the rotations of the cartridge main body 21. Also, by adopting the Reuleaux triangle, the shape of the barrel 24 of the cartridge 20 applied with the Reuleaux polygon can be the simplest shape, which can contribute to a reduction of the manufacturing costs of the toner cartridge 20.

In the printer 10 applied with the toner cartridge 20 as described above, various devices for image formation are provided inside the apparatus main body 11 of a box shape. The printer 10 is provided with the accommodation portion 30 including the inner surface with which the outer peripheral surface of the barrel 24 of the toner cartridge 20 comes into sliding contact and the cartridge attachment opening 341 through which the toner cartridge 20 is attached or detached in one end face and having a cross section in a direction orthogonal to the direction of the tube center line in the shape of a regular tetragon, the rotation mechanism 40 that rotates the toner cartridge 20 attached to the accommodation portion 30 in the circumferential direction, and the transportation mechanism 50 that transports the developer in the toner cartridge 20 to the developing device provided inside the apparatus main body 11 through the developer discharging orifice 231 opened by activating the shutter mechanism 25.

According to the printer 10 configured in this manner, by attaching the toner cartridge 20 inside the accommodation portion 30 and driving the rotation mechanism 40 in this state, the barrel 24 of the toner cartridge 20 inside the accommodation portion 30 starts to rotate and the developer in the barrel 24 is stirred effectively. The developer being stirred inside the barrel 24 is eventually replenished to the developing device 134 provided to the apparatus main body 11 of the image forming apparatus through the developer discharging orifice 231 by the driving of the transportation mechanism 50.

Because the accommodation portion 30, the rotation mechanism 40, and the transportation mechanism 50 are provided to the apparatus main body 11, it is possible to apply the stirring process to the developer in the barrel 24 effectively at the best of advantages of the toner cartridge 20 having the barrel 24 in the shape of the Reuleaux polygon.

Accordingly, even when the toner cartridge 20 is attached to the accommodation portion 30 after it has been stored over a long period in a vertical posture, lumps accumulated at the bottom of the cartridge main body 21 can be pulverized more effectively than in the conventional case. It thus becomes possible to prevent the occurrence of an inconvenience that the developer in the toner cartridge 20 cannot be replenished to the developing device 134 smoothly because of the presence of lumps.

The accommodation portion 30 is provided with a pair of the notch windows 321 formed by notching the mutually opposing wall surfaces so as to traverse the corresponding wall surfaces. Also, the rotation mechanism 40 includes a pair of the drive belts 41 looped over corresponding pairs of the rollers 42 provided in the vicinity of the both end portions of the respective notch windows 321, so that each circulates between the corresponding pair of the rollers 42 while abutting on the peripheral surface of the toner cartridge 20 in a state where they fit in the accommodation portion 30 to which the toner cartridge 20 is attached from the corresponding notch windows 321 and the drive motor 43 that drives the drive rollers in each pair of the rollers 42 to rotate.

Accordingly, by driving the drive rollers to rotate by the driving of the drive motor 43, the drive belts 41 looped over the corresponding pairs of the rollers 42 and allowed to abut on the barrel 24 of the cartridge main body 21 inside the accommodation portion 30 through the corresponding notch windows 321 notched in the respective opposing wall surfaces of the accommodation portion 30 are driven to circulate.

The barrel 24 is therefore guided as the drive belts 41 are driven to circulate and starts to rotate.

According to the rotation mechanism 40 configured as above, it is possible to rotate the toner cartridge 20 in a reliable manner with a simple structure.

The developer discharging orifice 231 is provided about the position of the center of gravity of the barrel 24 in the end wall of the toner cartridge 20. The transportation mechanism 50 includes the developer receiving and discharging pipe 52 that is inserted relatively into the developer discharging orifice 231 in a state where the toner cartridge 20 is attached inside the accommodation portion 30 and opens the developer discharging orifice 231 by pushing the circular shutter 282 and the spiral fin 532 internally attached to the developer receiving and discharging pipe 52 for receiving and discharging the developer inside the toner cartridge 20. The spiral fin 532 rotates on its axis about the center of its shaft while revolving about the tube center of the accommodation portion 30 in response to the circulations of the developer discharging orifice 231 caused by the rotations of the toner cartridge 20 in a state where the developer receiving and discharging pipe 52 is inserted into the developer discharging orifice 231.

According to the transportation mechanism 50 configured as above, the toner cartridge 20 rotates when driven by the drive motor 43 in a state where the toner cartridge 20 is attached to the accommodation portion 30 and the developer receiving and discharging pipe 52 is relatively inserted into the developing the developer discharging orifice 231 so that the circular shutter 282 is opened. The developer receiving and discharging pipe 52 also circulates in association with the circulations of the developer discharging orifice 231 by the rotations of the toner cartridge 20. As the circulations of the developer receiving and discharging pipe 52 are transmitted to the spiral fin 532, the spiral fin 532 rotates about the center of its shaft while revolving about the tube center of the accommodation portion 30. The developer discharged into the developer receiving and discharging pipe 52 through the developer receiving and discharging orifice 521*a* is therefore transported inside the developer receiving and discharging pipe 52 by the rotations of the spiral fin 532 on its axis and replenished to the developing device 134.

According to the transportation mechanism 50 described as above, it becomes possible to transmit the revolutions of the developer receiving and discharging pipe to the spiral fin 532, and the need to provide an exclusive-use drive source to drive the spiral fin 532 can be eliminated. This elimination of the need can contribute to a reduction of the cost of the apparatus.

It should be appreciated that the invention is not limited to the embodiment above and the invention also include the following contents.

(1) The embodiment above descried the printer 10 as an example of the image forming apparatus to which the toner cartridge 20 of the invention is applied. The invention, however, is also applicable to other types of image forming apparatus, such as a copying machine and a facsimile machine.

(2) The embodiment above described a case where the top face of the accommodation portion 30 in the shape of a square prism is completely covered with the top plate 33. However, instead of the top plate 33, one or more than one bar material may be bridged between the upper end portions of a pair of the side plates 32. According to this embodiment, too, the toner cartridge 20 is allowed to rotate while the barrel 24 comes into sliding contact with the bar material(s) inside the cartridge attachment chamber V1 by the driving of the drive belts 41.

(3) In the embodiment above, a pair of the drive belts 41 is provided so as to pinch the toner cartridge 20 inside the accommodation portion 30 from the sides. In addition to a pair of the drive belts 41, another pair of drive belts 41 may be additionally provided so as to pinch the toner cartridge 20 inside the accommodation portion 30 vertically. When configured in this manner, the toner cartridge 20 inside the accommodation portion 30 is in a state where it is wrapped and held by the drive belts 41 in four directions. A drive force of the drive belts 41 can be therefore transmitted to the toner cartridge 20 in a more reliable manner by the circulation driving of the respective drive belts 41.

Alternatively, the toner cartridge 20 inside the accommodation portion 30 may be received by the drive belt 41 from beneath. When configured in this manner, the toner cartridge 20 inside the accommodation portion 30 is in a state where it comes into close contact with the drive belt 41 by its own weight. Accordingly, the abutting state of the toner cartridge 20 on the drive belt 41 is stabilized. The toner cartridge 20 can be thus rotated in a reliable manner using a single drive belt 41. This configuration can therefore contribute to a reduction of the number of components.

In a case where it is configured in such a manner that the toner cartridge 20 inside the accommodation portion 30 is received on the drive belt 41 from beneath, the accommodation portion 30 to which the toner cartridge 20 is attached can be formed with an open top face. When the top face of the accommodation portion 30 is opened, it becomes possible to attach the toner cartridge 20 to the accommodation portion 30 and detach the former from the latter through the opening in the top face. This configuration can therefore facilitate the attachment and detachment operation of the toner cartridge 20 with respect to the accommodation portion 30.

More specifically, in the example shown in FIG. 1, the toner cartridge 20 is attached to and detached from the accommodation portion 30 from the left side face of the apparatus main body 11. However, for some types of printer 10, the top plate of the apparatus main body 11 is formed to be openable and closable (this configuration is more popular rather than the one described above). In the printer 10 of this type, because the toner cartridge 20 is attached to and detached from the accommodation portion 30 from above the apparatus main body 11, by adopting the accommodation portion 30 with the open top face, the toner cartridge 20 can be applied also to the printer 10 of this type.

(4) The embodiment above described a case where the shape of the Reuleaux triangle is applied to all of the left end wall 22, the right end wall 23, and the barrel 24 installed between a pair of these end walls 22 and 23 that together form the cartridge main body 21. It should be appreciated, however, that the shape of the Reuleaux triangle does not have to be applied to the barrel 24 entirely, and it is sufficient to apply the shape of the Reuleaux triangle to the barrel 24 at least in part.

Figure 11:
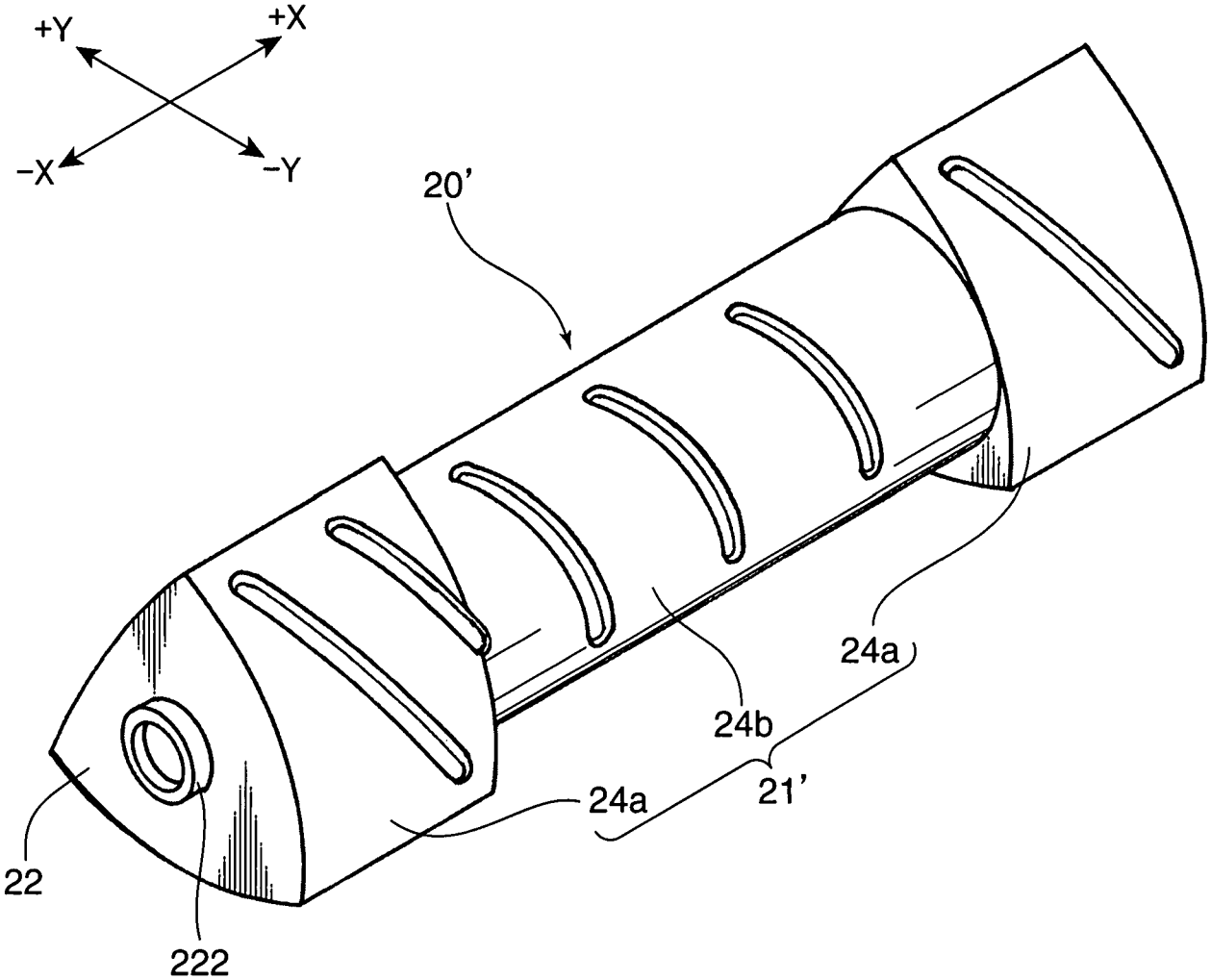
FIG. 11 is a perspective view showing an example of another embodiment of the toner cartridge.

FIG. 11 is a perspective view showing an example of another embodiment of the toner cartridge 20 as above. Indications of direction in FIG. 11 using letters X and Y are the same as in FIG. 1 (X is the right-left direction (−X: leftward, +X: rightward) and Y is the front-rear direction (−Y: frontward, +Y: rearward).

As is shown in FIG. 11, a toner cartridge 20' of this embodiment is configured in such a manner that the cartridge main body 21' includes a pair of side barrels 24*a* in the right-left direction and a center barrel 24*b* installed between a pair of these side barrel 24*a*.

As with the cartridge main body 21 of the embodiment described above, each side barrel 24*a* is formed in the shape of the Reuleaux triangle when viewed in the right-left direction. The left end wall 22 of the side barrel 24*a* on the left is provided with a cap 222 that clogs the developer filling orifice in the same manner as the counterpart in the embodiment above. A shutter mechanism 25 same as the counterpart in the embodiment above (FIG. 2) is internally attached to the side barrel 24*a* on the right.

The center barrel 24*b* is formed of a circular tubular body installed concentrically between the respective side barrels 24*a*. A diameter dimension of the center barrel 24*b* is set in such a manner that three points on the outer peripheral surface divided equally in the circumferential direction become flush with the respective arc-shaped outer peripheral surfaces of each side barrel 24*a*.

In the toner cartridge 20' of this modification, the rotation mechanism 40 (FIG. 7) of the embodiment above is provided to either one or both of a pair of the side barrels 24*a*. The toner cartridge 20' is rotated by the driving of the rotation mechanism 40.

According to the toner cartridge 20' configured as above, by providing the center barrel 24*b* in the shape of a circular column between a pair of the side barrels 24*a*, the user becomes able to hold the center barrel 24*b* with ease. This configuration therefore makes the toner cartridge 20' easy to carry and facilitates the attachment and detachment operation with respect to the printer 10.

(5) In the embodiment above, the cartridge attachment opening 341 of a similar shape with the sectional shape of the toner cartridge 20 is provided to the left surface plate 34 of the accommodation portion 30. However, the shape of the cartridge attachment opening 341 is not limited to such a similar shape and can be set to any shape as long as the base 24 can be inserted therein.

In this case, it should be noted, however, that the phase about the tube center of the toner cartridge 20 inserted into the accommodation portion 30 becomes uncertain. Accordingly, when the toner cartridge 20 is inserted into the accommodation portion 30, the coupling cylinder 232 of the toner cartridge 20 may not be externally fit to the transverse pipe 521 positioning at the lowermost position of the transportation mechanism 50. In order to eliminate such an inconvenience, it is preferable to provide a guide that guides the phase of the toner cartridge 20 at an appropriate point of the accommodation portion 30 or a trumpet-shaped tubular body that widens toward the tip and is thereby capable of trapping the tip end of the transverse pipe 521 may be provided to extend on the tip end side of the coupling cylinder 232.

When configured in this manner, the coupling cylinder 232 can be readily externally fit to the transverse pipe 521 when the toner cartage 20 is pushed into the accommodation portion 30 regardless of the phase of the toner cartridge 20, because the toner cartridge 20 is guided by the guide or the tip end of the coupling cylinder 232 is guided by the trumpet-shaped tubular body.

In addition, a mark indicating the phase of the toner cartridge 20 to be inserted may be provided to an appropriate point on the outer surface of the accommodation portion 30, so that the toner cartridge 20 can be inserted into the accommodation portion 30 in accordance with this mark.

(6) The embodiment above described a case where the shape of the Reuleaux triangle is applied to the sectional shape of the barrel 24 of the toner cartridge 20. However, the Reuleaux pentagon and the Reuleaux heptagon may be applied as well.

(7) In the embodiment above, the diameter dimension of the circulation gear 551 of the transportation mechanism 50 is set to be the same as the major diameter dimension of the transverse pipe 521 of the developer receiving and discharging pipe 52. However, the diameter dimension of the circulation gear 551 may be smaller than the diameter dimension of the transverse pipe 521 or larger than the major diameter dimension. The size and the shape of the internal gear 552 are set according to the diameter dimension of the circulation gear 551.

(8) The embodiment above adopts a member having an inner space in the shape of a regular tetragon when viewed in a cross section as the accommodation portion 30. However, besides this member, it is possible to adopt a polygon having more angles than a regular tetragon and also to adopt a toner cartridge in the shape of the Reuleaux polygon that conforms to an angular tubular, body formed of a polygon having more angles than the regular tetragon.

In this case, given that the number of angles of the angular tubular body is 2n (n=3, 4, and so forth), then the Reuleaux polygon of the corresponding toner cartridge has the number of angles, 2n−1 (n=3, 4, and so forth).

Figure 12A:
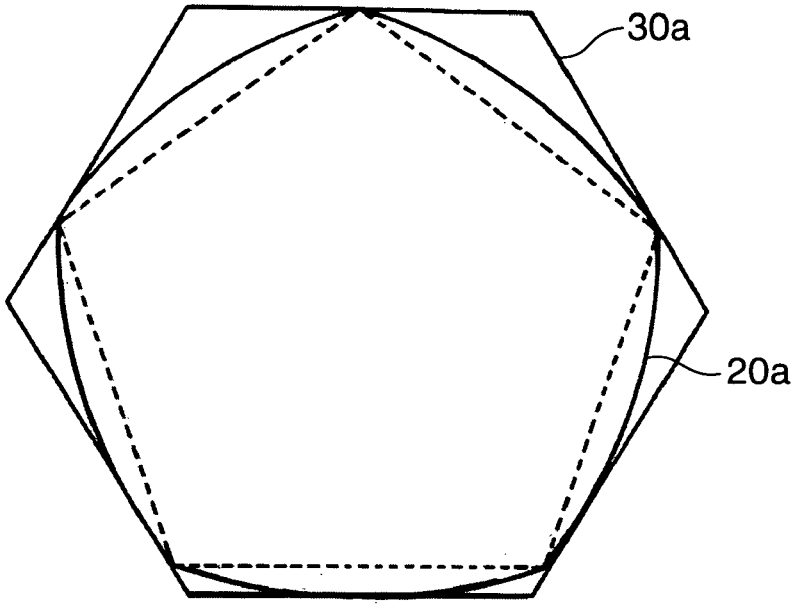
FIGS. 12A and 12B are views showing an angular tubular body and a toner cartridge internally attached therein in a case where the angular tubular body is a regular polygon having more angles than a regular tetragon.
Figure 12B:
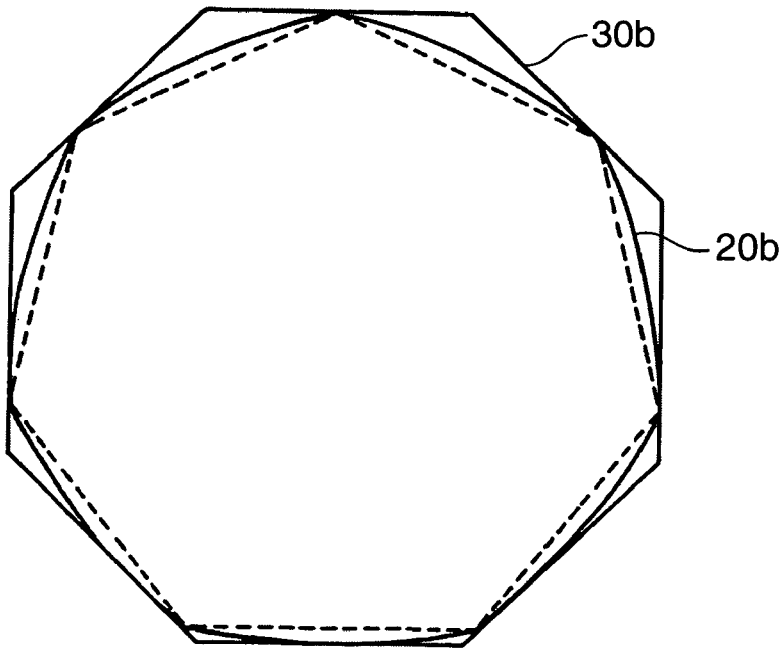

FIGS. 12A and 12B are views showing an angular tubular body and a toner cartridge internally attached thereto in a case where the angular tubular body is a regular polygon having more angles than a regular tetragon. FIG. 12A shows a case where the angular tubular body is a regular hexagon. FIG. 12B shows a case where the angular tubular body is a regular octagon.

In the case of an accommodation portion 30*a* of a regular hexagon, as is shown in FIG. 12A, a toner cartridge 20*a* to which is applied the Reuleaux pentagon is adopted. Also, in the case of an accommodation portion 30*b* of a regular octagon, as is shown in FIG. 12B, a toner cartridge 20*b* to which is applied the Reuleaux heptagon is adopted.

By adopting the Reuleaux polygons having more angles than the Reuleaux triangle in this manner, it becomes possible to increase a volume of the toner cartridge.

(9) The embodiment above adopts an angular tubular body as the accommodation portion 30. However, it is sufficient for the accommodation portion 30 to have the shape of a regular tetragon at least as the sectional shape of a space in which the toner cartridge 20 or 20' is attached (that is, as the sectional shape of the inner surface of a portion with which the outer peripheral surface of the barrel 24 of the cartridge main body 21 comes into sliding contact), and the outward appearance is not necessarily in the shape of an angular tubular body.

(10) The embodiment above described a case where the Reuleaux polygon is adopted as the sectional shape of the cartridge main body 21 of the toner cartridge 20. In other words, the Reuleaux polygons are described as examples of the shape of almost a curve of constant width other than a circle. However, the sectional shape of the cartridge main body 21 is not necessarily the Reuleaux polygon and it may be of the shape of a curve of constant width having a shape in which the angular portions of the Reuleaux polygon are shaped like an arc.

Figure 13A:
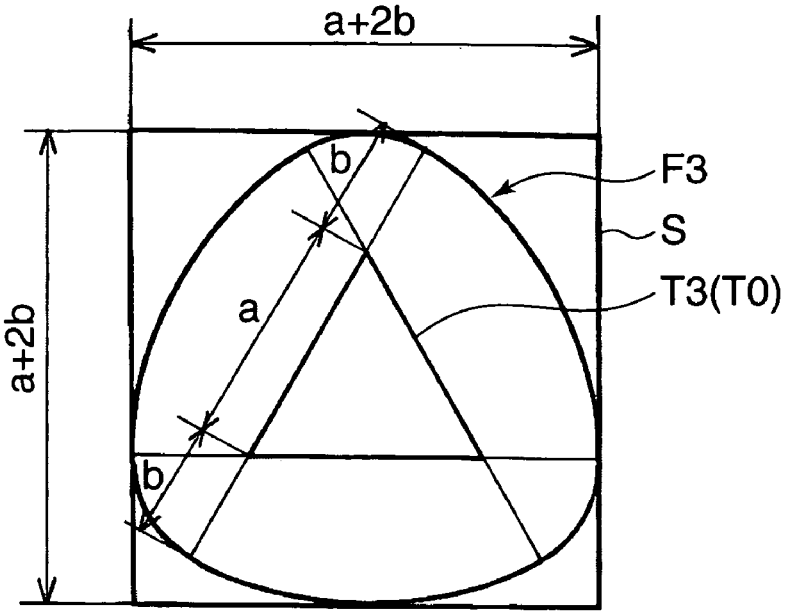
FIGS. 13A and 13B are views used to describe a figure of constant width.
Figure 13B:
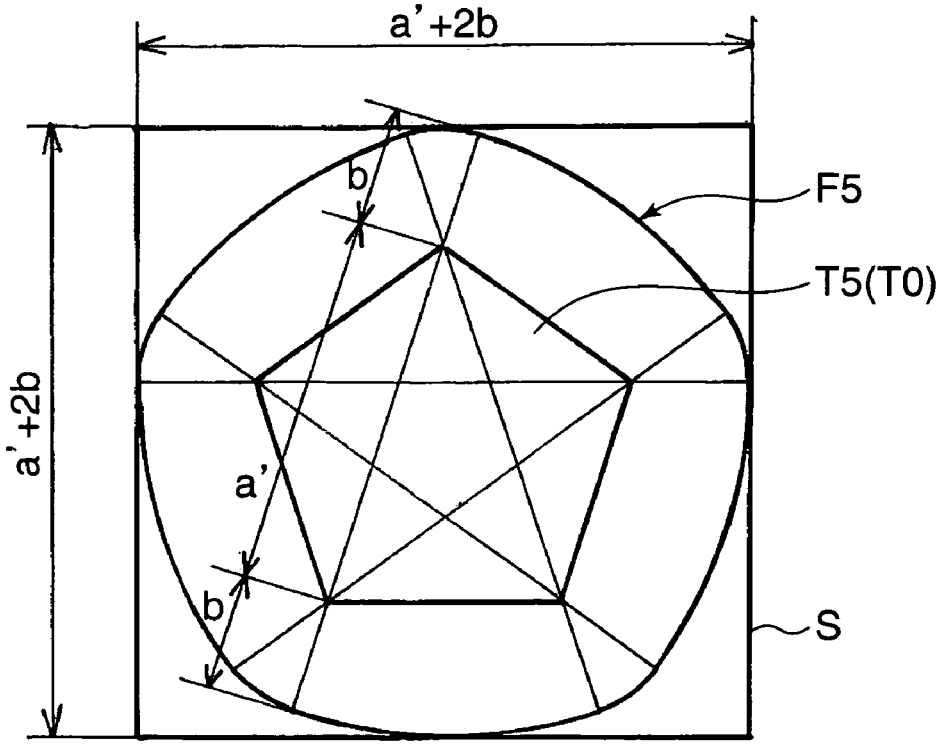

FIGS. 13A and 13B are views used to describe such a figure of constant width. FIG. 13A shows a figure of constant width, F3, of a triangle type in a case where the base figure is a regular triangle. FIG. 13B shows a figure of constant width, F5, of a pentagon type in a case where the base figure is a regular pentagon.

Firstly, the curve of constant width, F3, of a triangle type in a case where the base figure T0 is a regular triangle T3 will be described on the basis of FIG. 13A. The curve of constant width, F3, of a triangle type is a figure obtained by smoothly connecting arcs of a small circle with a radius "b" centered at the respective vertices of the regular triangle T3 with a side length "a" drawn toward the outside of the triangle and arcs of a large circle with a radius a+b centered at the respective vertices of the regular triangle T3 and drawn toward the direction of the center of gravity of the triangle.

The curve of constant width, F3, of a triangle type obtained in this manner is allowed to rotate inside a regular tetragon S with a side length a+2b while it always abuts on the respective sides at four points. The same can be said about a case of the Reuleaux triangle T.

Secondly, the curve of constant width, F5, of a pentagon type in a case where the base figure T0 is a regular pentagon T5 will be described on the basis of FIG. 13B. The curve of constant width, F5, of a pentagon type is a figure obtained by smoothly connecting arcs of a small circle with a radius b centered at the respective vertices of the regular pentagon T5 with a diagonal length a' and drawn toward the outside of the pentagon and arcs of a large circle with a radius a'+b centered at the respective vertices of the regular pentagon T5 toward a direction of the center of gravity of the pentagon.

The curve of constant width, F5, of a pentagon type obtained in this manner is allowed to rotate inside a regular tetragon S with a side length a'+2b while it always abuts on the respective sides at four points.

Accordingly, the shapes of the curve of constant widths, F3 and F5, as described above can be adopted as the sectional shape of the cartridge main body 21 of the embodiment above when viewed from the end face instead of the shape of the Reuleaux triangle T because each of the curve of constant width, F3, of a triangle type and the curve of constant width, F5, of a pentagon type as above is allowed to rotate inside the regular tetragon S while coming into contact with the respective sides of the regular tetragon S at four points.

In a case where the curve of constant width, F3 or F5, is adopted as the sectional shape of the cartridge main body 21 when viewed from the end face instead of the Reuleaux triangle T, acute angular portions are absent in the cartridge main body 21 when viewed from the end face and the angular portions are shaped like an arc. This portion abuts on the inner wall surface of the accommodation portion 30 in a more smooth state. This configuration therefore can contribute to smooth rotations of the cartridge main body 21.

FIGS. 13A and 13B show the curve of constant width, F3, of a triangle type and the curve of constant width, F5, of a pentagon type as examples of a curve of constant width. It should be appreciated, however, a curve of constant width whose base figure T0 is a regular 2n+1 (n is a natural number) polygon can be adopted as well.

(11) The embodiment above described a case where the sectional shape of the toner cartridge itself is the shape of the Reuleaux polygon (almost a curve of constant width other than a circle). However, it may be configured in such a manner that the toner cartridge having an arbitrary sectional shape is formed as a type that is attached to and detached from an adaptor and the outer shape of the cross section of the adaptor is the shape of the Reuleaux polygon.

Figure 14A:
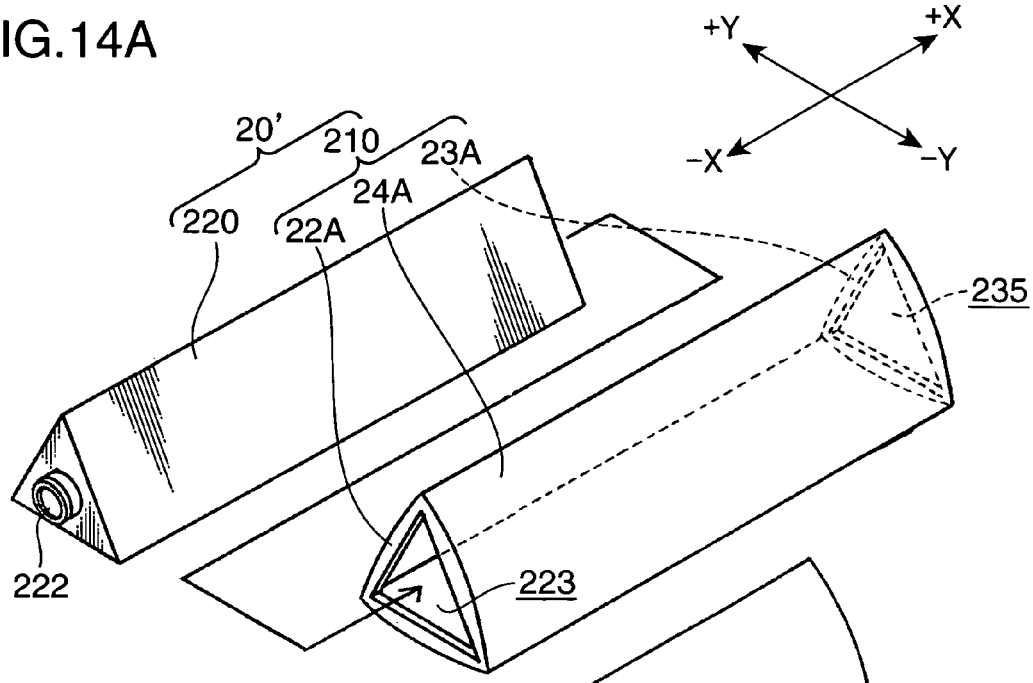
FIGS. 14A through 14C are perspective views showing a toner cartridge assembly (toner cartridge adaptor) of the invention.
Figure 14B:
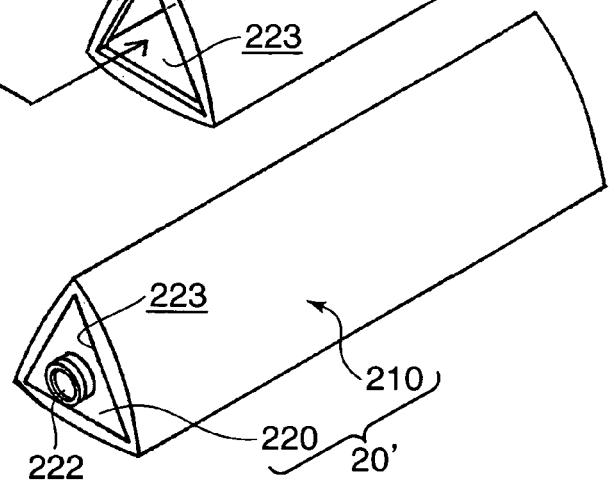
Figure 14C:
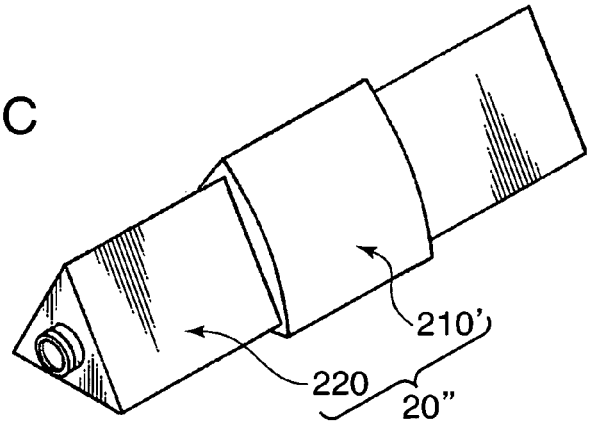

FIGS. 14A and 14B are perspective views showing an adaptor for the toner cartridge (toner cartridge assembly) of this modification. FIG. 14A and FIG. 14B show a toner cartridge assembly 20' of an all accommodation type in which a toner cartridge 220 is entirely accommodated in an adaptor 210 (FIG. 14A shows a state where the toner cartridge 220 is pulled out from the adaptor 210 and FIG. 14B shows a state where the toner cartridge 220 is accommodated in the adaptor 210). FIG. 14C shows a toner cartridge assembly 20" of a partial accommodation type in which the toner cartridge 220 penetrates through an adaptor 210'. Indications of direction in FIGS. 14A, 14B and 14C using letters X and Y are the same as in FIG. 2 (X is the right-left direction (−X: leftward, +X: rightward) and Y is the front-rear direction (−Y: frontward, +Y: rearward)).

As are shown in FIG. 14A and FIG. 14B, the toner cartridge assembly 20' of the all accommodation type includes the adapter 210 whose sectional shape when viewed from the end face is the shape of the Reuleaux polygon or the shape of a curve of constant width (the shape of the Reuleaux triangle is shown in FIG. 14), and the toner cartridge 220 that is entirely attachable to and detachable from the adaptor 210.

The shape of the outward appearance of the adaptor 210 is set to the same shape of the cartridge main body 21 described in the embodiment above. Hence, it includes a left end wall 22A and a right end wall 23A in the shape of the Reuleaux triangle and a tubular barrel 24A installed between these end walls 22A and 23A. A triangular hole 223 of a regular triangular shape opened to the largest extent possible and slightly larger than the sectional shape of the toner cartridge 220 to be attached is perforated in the left end wall 22A and a similar triangular hole 235 is perforated in the right end wall 23A. The barrel 24A has an accommodation space for the toner cartridge 220 in the interior thereof. Herein, assume that the inner surface shape of this accommodation space and the outer shape of the toner cartridge 220 almost conform to each other.

In order to correspond to the triangular holes 223 and 235, the shape of the toner cartridge 220 when viewed from the end face is set to the shape of a regular triangle. A developer filling orifice is provided to the front end face of the toner cartridge 220 configured as above, and a cap 222 is fit in the filling orifice in a state where the toner cartridge 220 is filled with the developer through the filling orifice. Also, an opening and closing mechanism 280 same as the counterpart in the embodiment above (see FIG. 2) is provided inside the toner cartridge 220 at the right end.

The toner cartridge assembly 20' configured as above may be attached to and detached from the accommodation portion 30 as with the toner cartridge 20 in the embodiment above. Alternatively, it may be configured in such a manner that the adaptor 210 is kept attached to the accommodation portion 30, so that the toner cartridge 220 alone is attached to and detached from the adaptor main body 210.

This modification described a case where a rotation stopping hole of the adaptor 210 is the triangular holes 223 and 235 and the shape of the toner cartridge 220 when viewed from the end face is a regular triangle that corresponds to the triangular holes 223 and 235 by way of example. It should be appreciated, however, that the shapes of the rotation stopping holes and the barrel 24 when viewed from the end face may be of any shape as long as it is a shape that can be rotated integrally with the adaptor 210. In a case where the shape of the toner carriage 220 when viewed from the end face is a circle, it may be configured in such a manner that a protrusion for stopping rotations is provided from the peripheral surface and a concave portion corresponding to this protrusion is provided at the peripheral edge of the opening in the adaptor 210.

Subsequently, as is shown in FIG. 14C, the toner cartridge assembly 20" of the partial accommodation type is set in such a manner that a length dimension of the adaptor 210' is shorter than the toner cartridge 220. Accordingly, in an assembled state, the toner cartridge 220 penetrates through the adaptor 210' and the end portions on right and left stick out to the outside from the adaptor 210'. The other configurations of the toner cartridge assembly 20" except for the adaptor 210' that is made shorter are the same as the toner cartridge assembly 20' of the all accommodation type shown in FIG. 14A and FIG. 14B. According to this modification, the cost can be reduced and the space can be saved because the adaptor main body portion 210' is made shorter.

Figure 15:
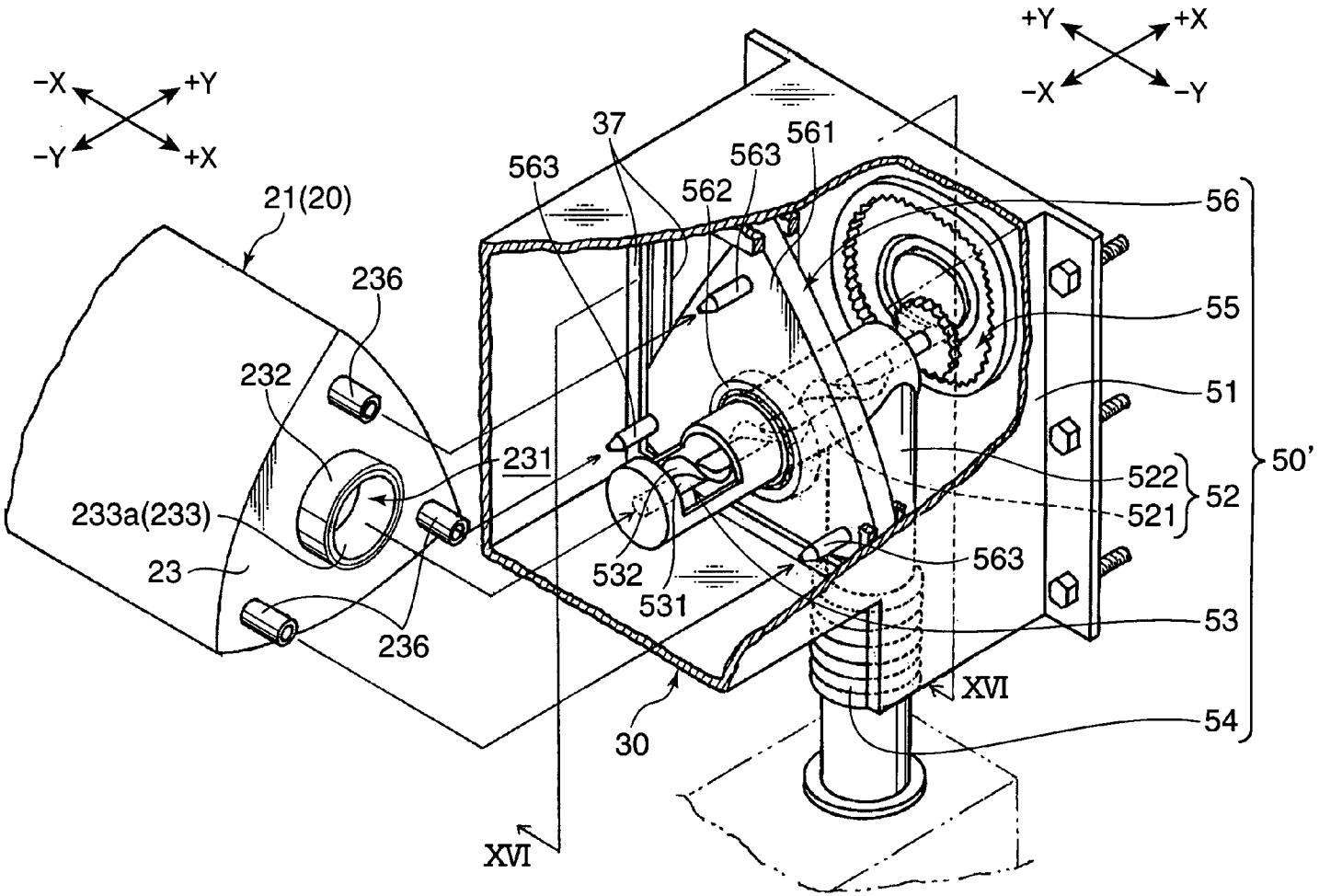
FIG. 15 is a partially notched perspective view showing still another embodiment of the transportation mechanism.
Figure 16A:
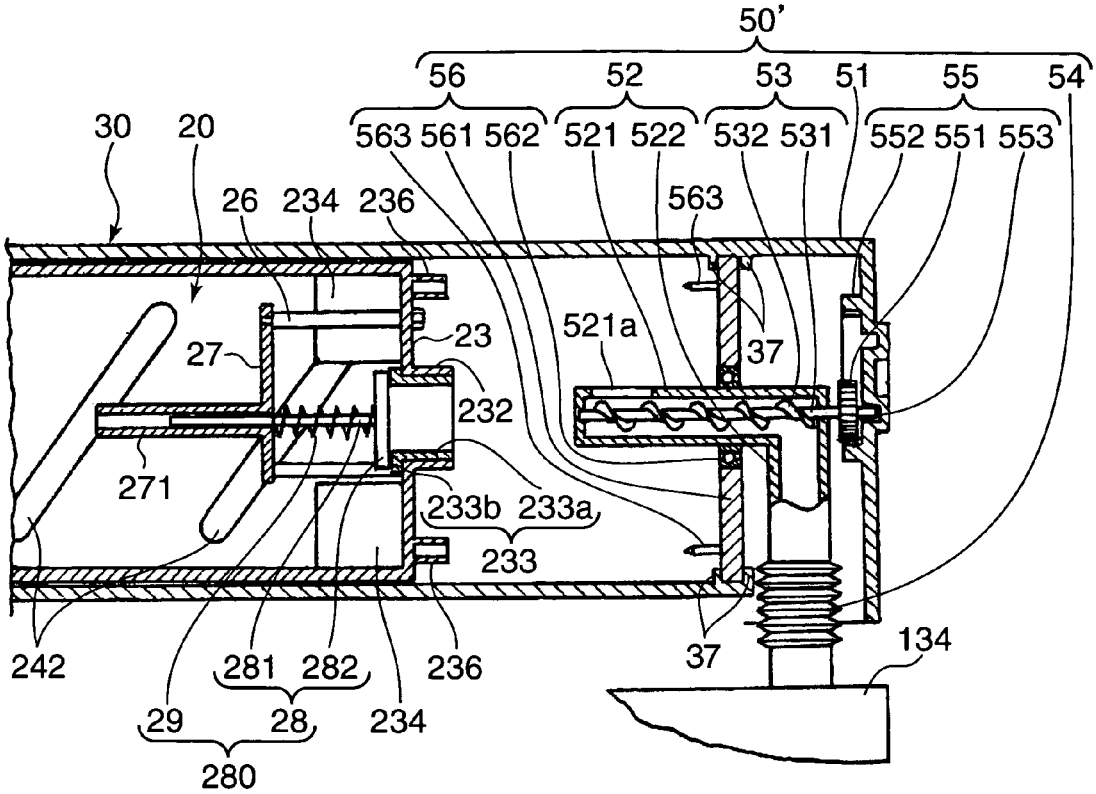
FIGS. 16A and 16B are cross sections taken on line XVI-XVI of FIG. 15.
Figure 16B:
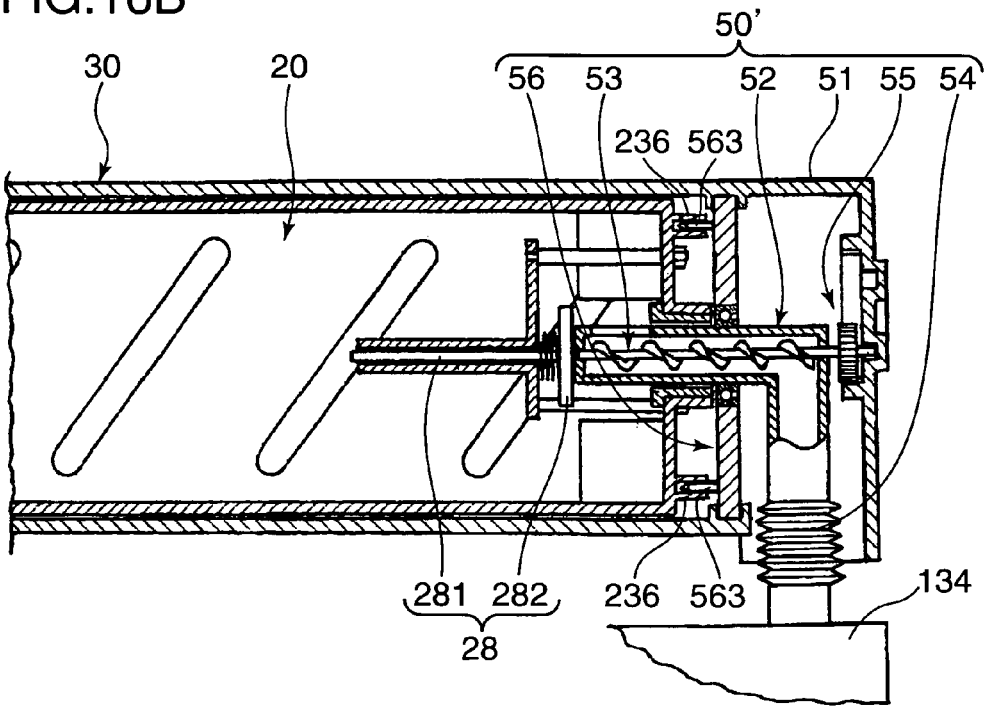

(12) A transportation mechanism 50' shown in FIG. 15 and FIG. 16 may be adopted instead of the transportation mechanism 50 shown in FIG. 8 and FIG. 9 and described above. FIG. 15 is a partially notched perspective view showing the transportation mechanism 50' according to still another embodiment. FIGS. 16A and 16B are cross sections taken on line XVI-XVI of FIG. 15. FIG. 16A shows a state before the toner cartridge 20 is coupled to the transportation mechanism 50' and FIG. 16B shows a state where the toner cartridge 20 is coupled to the transportation mechanism 50'. Indications of direction in FIG. 15 and FIGS. 16A and 16B using letters X and Y are the same as in FIG. 8 (X is the right-left direction (−X: leftward, +X: rightward) and Y is the front-rear direction (−Y: frontward, +Y: rearward)).

As is shown in FIG. 15, in addition to the frame body 51, the developer receiving and discharging pipe 52, the spiral feeder 53, the flexible pipe 54, and the gear mechanism 55, which are the components of the transportation mechanism 50 of the embodiment above, the transportation mechanism 50' is formed by including a pipe supporting member 56 that supports the transverse pipe 521 for allowing smooth circulation motion of the transverse pipe 521 of the developer receiving and discharging pipe 52.

The pipe supporting member 56 includes a pipe supporting plate body 561 in the shape of the Reuleaux triangle same as the shape of the cartridge supporting body 21 when viewed from the end face, a bearing 562 that is fit to the pipe supporting plate member 561 at the position of the center of gravity and into which the transverse pipe 521 is inserted, and a plurality (three in the case shown in FIG. 15) of stopping pins 563 provided to protrude from the left surface of the pipe supporting plate body 561 at regular pitches in the circumferential direction.

A pair of angular annular guide rails 37 in the right-left direction is provided fixedly on the inner wall surface of the accommodation portion 30 at the boundary position between the frame body 51 and the accommodation portion 30 of an angular tubular body. The pipe supporting body 561 is attached to the accommodation portion 30 in a state where the edge portion is pinched by a pair of these angular annular guide rails 37 and the transverse pipe 521 is inserted into the bearing 562.

Meanwhile, stopping tubular bodies 236 are provided to protrude from the right end wall 23 of the cartridge main body 21 at positions opposing the respective stopping pins 563. Accordingly, by pushing the cartridge main body 21 into the accommodation portion 30, the respective stopping tubular bodies 236 are externally fit to the corresponding stopping pins 563. Rotations of the cartridge main body 21 are transmitted to the pipe supporting plate body 561 via these stopping tubular bodies 236 and stopping pins 563. The pipe supporting plate body 561 thus becomes able to rotate stably in the same manner as the cartridge main body 21 rotates in a state where it is pinched by a pair of the angular annular guide rails 37.

According to the transportation mechanism 50' configured as above, when the cartridge main body 21 is pushed into the accommodation portion 30 as is shown in FIG. 16A, not only the coupling cylinder 232 is externally fit to the transverse pipe 521 of the developer receiving and discharging pipe 52, but also the respective stopping cylinders 236 are externally fit to the corresponding stopping pins 563. Consequently, as is shown in FIG. 16B, the cartridge main body 21 is brought into a state where it is coupled to the pipe supporting plate body 561 in an integrally rotatable manner via the stopping tubular bodies 236 and the stopping pins 563.

Accordingly, when the cartridge main body 21 in this state is rotated by the driving of the rotation mechanism 40 (FIG. 7), the rotations are transmitted to the pipe supporting plate body 561. The pipe supporting plate body 561 is thus rotated and the rotations are transmitted to the transverse pipe 521 via the bearing 562, which allows the developer receiving and discharging pipe 52 to rotate stably in a reliable manner.

The specific embodiments described above chiefly include inventions having the following configurations.

A toner cartridge according to one aspect of the invention includes a cartridge main body as a container having a tubular barrel and filled with a developer, and the barrel has at least in part a portion whose outer shape of a cross section orthogonal to a direction of a tube center line is a shape of almost a curve of constant width other than a circle.

According to the toner cartridge configured as above, when the barrel of the cartridge main body is rotated inside a predetermined frame having a cross section in the shape of a regular tetragon (hereinafter, referred to as the square frame) in a state where it sandwiches the barrel with a pair of first surfaces (for example, horizontal surfaces) parallel to each other and extending in the direction of the tube center line and a pair of second surfaces (for example, vertical surfaces) parallel to each other while being orthogonal to the first surfaces and extending in a direction in which the barrel center line extends, the position of the center of gravity of a curve of constant width circulates at an angular rate several times (for example, three times in a case where a curve of constant width corresponds to a triangle, five times in a case where a curve of constant width corresponds to a pentagon, and seven times in a case where it corresponds to a heptagon) higher than the angular rate of the barrel in an direction opposite to the direction of rotation.

Accordingly, by rotating the barrel of the cartridge main body inside the square frame, regarding the developer inside the barrel, forces heading toward opposite directions act respectively on the developer in the vicinity of the position of the center of gravity and the developer around this developer. The developer is thus loosened effectively. Consequently, the developer inside the toner cartage can be stirred in a more reliable manner than the conventional case where the toner cartridge is formed of a circular tube (in the case of a circular tube, the position of the center of gravity does not circulate).

In addition, by rotating the barrel of the cartridge main body inside the square frame, a direction of a force applied to the developer filled in the barrel varies abruptly for each rotation by a predetermined angle corresponding to the number of angular portions formed in the barrel (that is, a point of displacement is present). Accordingly, in comparison with the conventional toner cartridge in which such a point of displacement is absent, the developer inside the toner cartridge can be stirred in a more reliable manner.

In a case where the toner cartridge has been stored, for example, in a vertical posture over a long period, the developer may possibly fall down on the lower portion inside the cartridge main body in a vertical posture and it may be hardened to form lumps. However, the lumps can be readily pulverized by a stirring force developed with high-speed rotations of the developer at the position of the center of gravity or an abrupt change in direction of a force applied to the developer caused by rotating the toner cartridge inside the square frame. It thus becomes possible to prevent the occurrence of inconveniences that the developer is not replenished smoothly from the toner cartridge to the developing device or the toner cartridge has to be replaced with a new one even when a considerable amount of developer remains inside because of the presence of the lumps.

In the configuration above, it is defined that the cross section of the barrel orthogonal to the direction of the tube center line is in the shape of almost a curve of constant width for the reason as follows. That is, for example, in a case where a part of the surface of the barrel is diagonally recessed linearly, the barrel may be in a state where the contour of the sectional shape of the barrel in the direction orthogonal to the center line extending in the longitudinal direction does not form an exact curve of constant width and a recessed portion is present. The word, "almost" is used to indicate that a part of the contour of the barrel can have such a recessed portion. In other words, it is sufficient that a contour line of a figure obtained by projecting the barrel in a direction of the center line of the barrel forms the shape of a curve of constant width.

In the configuration above, it is preferable that the shape of the curve of constant width is a shape of a Reuleaux polygon.

The Reuleaux polygon is one type of a curve of constant width and obtained by drawing an arc between opposing two vertices centered at the respective vertices as the center of curvature with a radius equal to a diagonal (a side length in a case where the base polygon is a triangle and a longest diagonal in a case where there is more than one diagonal) of a regular polygon having an odd number of angles (hereinafter, referred to as the base polygon). In short, it is a figure having angular portions and the center of gravity moves considerably when it is rotated. Hence, by setting the cross section of the toner cartridge when viewed in a cross section to be of the shape of the Reuleaux polygon, the loosening effect of the developer can be enhanced.

In the configuration described above, it is preferable that: the cartridge main body has a pair of end walls opposing each other; the barrel is installed between the pair of end walls; and a discharging orifice for discharging the developer is provided to one of the pair of end walls.

According to this configuration, because the cartridge main body is formed by installing the barrel between a pair of the end walls, the cartridge main body has a simple structure and can be manufactured with ease. The developer in such a toner cartridge main body is discharged through the discharging orifice provided to one of the pair of end walls. Accordingly, in comparison with a case where the discharging orifice is provided to the barrel, a movable range of the discharging orifice is small, which makes it easy to discharge the developer.

In this case, it is preferable that the developer discharging orifice is provided at a position of a center of gravity of the Reuleaux polygon of the one of the pair of end walls.

According to this configuration, by rotating the barrel of the cartridge main body inside the square frame, it becomes possible to discharge the developer uniformly to the outside through the developer discharging orifice at any position on the cartridge main body in the circumferential direction. Hence, so-called a dead corner at which it becomes difficult to discharge the developer locally in the cartridge main body is hardly produced. In addition, in a case where a predetermined pipe is fit into the developer discharging orifice and the developer inside the toner cartridge is discharged via this pipe, because the discharging orifice is provided at the position of the center of gravity of the Reuleaux polygon in the end wall, an amount of movement of the pipe can be suppressed to the minimum in contrast to a case where the discharging orifice is provided at a position other than the position of the center of gravity. This is preferable when the structure to discharge the developer is designed.

In the configuration above, it is preferable that a shutter mechanism that opens and closes the developer discharging orifice, is further included, and that the shutter mechanism includes a shutter plate that closes the developer discharging orifice from inside the cartridge main body in a re-openable manner and a biasing member that biases the shutter plate toward the developer discharging orifice.

According to this configuration, the developer discharging orifice is normally kept in a closed state because the shutter plate is pushed from inside the cartridge main body by a biasing force of the biasing member. Meanwhile, the developer discharging orifice is opened by pressing the shutter plate from outside the cartridge main body against a biasing force of the biasing member. It thus becomes possible to make the structure of the shutter mechanism simpler on one hand and facilitate the opening and closing operation of the shutter plate on the other hand.

In the configuration above, it is preferable that a protrusion is provided to the one of the pair of end walls to which the discharging orifice is provided so as to protrude toward the other end wall.

According to this configuration, even when a remaining amount of the developer inside the toner cartridge becomes small, the protrusion provided to one of the pair of end walls to which the discharging orifice is provided so as to protrude toward the other end wall scoops up the developer in response to rotations of the toner cartridge and forces the developer toward the discharging orifice. It thus becomes possible to prevent the occurrence of an inconvenience that the developer that was not discharged remains inside the toner cartridge.

In the configuration above, it is preferable that a rib for developer transportation is provided on an inner peripheral surface of the barrel so as to protrude inward.

According to this configuration, by rotating the barrel of the cartridge main body inside the square frame, the developer positioned on the inner peripheral surface of the barrel inside the cartridge main body is stirred by the rib provided to protrude on the inner peripheral surface. Consequently, the developer inside the barrel can be stirred effectively across the full length.

In the configuration above, it is preferable that the polygon used as a base of the figure of constant width is a triangle. According to this configuration, an amount of movement of the center of gravity of the toner cartridge becomes larger, which can enhance the loosening effect of the developer.

In addition, when the polygon used as the base of the curve of constant width is the Reuleaux triangle, an amount of movement of the position of the center of gravity reaches the maximum in comparison with a Reuleaux polygon having more angles. The stirring effect of the developer inside the toner cartridge in response to rotations of the toner cartridge can be therefore enhanced.

An adaptor for toner cartridge according to another aspect of the invention includes an adaptor main body having a tubular barrel and an accommodation space for a toner cartridge in an interior thereof, and the barrel has at least in part a portion whose outer shape of a cross section orthogonal to a direction of a tube center line is a shape of almost a curve of constant width other than a circle. In this case, it is preferable that a shape of a figure of constant width is a shape of a Reuleaux polygon.

According to this embodiment, it becomes possible to form the toner cartridge in a shape simple and easy to handle, which is advantageous at the time of transportation and storage. In addition, the toner cartridge can be manufactured at a low cost. Further, because it is possible not to provide a rotation force directly to the toner cartridge, the strength of the housing of the toner cartridge can be set lower.

A toner cartridge assembly according to still another aspect of the invention includes an adaptor that includes an adaptor main body having a tubular barrel and an accommodation space in an interior thereof, the barrel having at least in part a portion whose outer shape of a cross section orthogonal to a direction of a tube center line is a shape of almost a curve of constant width other than a circle, and a toner cartridge accommodated in the accommodation space and filled with a developer inside. It is preferable that a shape of a curve of constant width is a shape of a Reuleaux polygon.

In this case, it is preferable that the toner cartridge has an outer surface shape that almost conforms to an inner surface shape of the accommodation space. According to this configuration, the toner cartridge is allowed to rotate integrally with the adaptor main body in a state where it is accommodated in the accommodation space while increasing the volume to the maximum.

An image forming apparatus according to still another aspect of the invention is characterized by including: an apparatus main body of a box shape in which various image forming devices are provided; the toner cartridge, the adaptor for toner cartridge, or the toner cartridge assembly described above, each of which is attached detachably to the apparatus main body; an accommodation portion including an inner surface with which an outer peripheral surface of the barrel of the toner cartridge or the adaptor comes into sliding contact and an opening provided to one end face through which the toner cartridge or the adaptor is attached and detached and having a cross section in a direction orthogonal to a direction of a tube center line in a shape of a regular tetragon; a rotation mechanism configured to rotate the toner cartridge or the adaptor attached to the accommodation portion in a circumferential direction; and a transportation mechanism configured to transport the developer inside the toner cartridge to the image forming components provided inside the apparatus main body through a developer discharging orifice provided to the toner cartridge.

According to this configuration, by attaching the toner cartage or the adapter inside the accommodation portion in the shape of a regular tetragon when viewed in a cross section and driving the rotation mechanism, the barrel of the toner cartridge or the adaptor inside the accommodation portion starts to rotate and the developer inside the barrel can be stirred effectively. The developer being stirred in the barrel is eventually replenished to the image forming devices provided inside the apparatus main body of the image forming apparatus through the developer discharging orifice by the driving of the transportation mechanism. It thus becomes possible to apply the stirring process to the developer inside the barrel effectively at the best of advantages of the toner cartridge or the adaptor having the barrel in the shape of the Reuleaux polygon. Hence, even when the toner cartridge that has been stored in a vertical posture over a long period is attached to the accommodation portion, the lumps of the developer accumulated at the bottom can be effectively pulverized in comparison with the conventional case.

An image forming apparatus according to still another aspect of the invention is characterized by including: the toner cartridge, the adaptor for toner cartridge, or the toner cartridge assembly described above; an accommodation portion including an inner surface with which an outer peripheral surface of the barrel of the toner cartridge or the adaptor comes into sliding contact and an opening provided to one end face through which the toner cartridge or the adaptor is attached and detached and having a cross section in a direction orthogonal to a direction of a tube center line in a shape of a regular polygon; a rotation mechanism configured to rotate the toner cartridge or the adaptor attached to the accommodation portion in a circumferential direction; and a transportation mechanism configured to transport the developer inside the toner cartridge to the image forming components provided inside the apparatus main body through a developer discharging orifice provided to the toner cartridge, wherein the regular polygon is a 2n (where n is a natural number equal to 3 or larger) polygon and a shape of the Reuleaux polygon of the toner cartridge or the adaptor is almost a Reuleaux (2n−1) polygon.

According to the image forming apparatus configured as above, because the Reuleaux polygon adopted as the sectional shape of the barrel of the toner cartridge has more angles than the Reuleaux triangle, a developer storing volume of the toner cartridge can be increased.

In the configuration above, it is preferable that the accommodation portion is provided with a notch window notched so as to traverse a wall surface that defines the accommodation portion, and that the rotation mechanism includes a drive belt that circulates while abutting on an outer peripheral surface of the toner cartridge or the adaptor in a state where the drive belt fits into the accommodation portion from the notch window, a drive roller and a driven roller over which the drive belt is looped, and a drive motor that drives the drive roller to rotate.

According to this configuration, the toner cartridge or the adaptor is guided by circulation driving of the drive belt and is thereby rotated in a reliable manner.

In the configuration above, it is preferable that: the developer discharging orifice is provided about a position of a center of gravity of the barrel in the end wall of the toner cartridge; the transportation mechanism includes a developer receiving and discharging pipe that is inserted relatively into the developer discharging orifice in a state where the toner cartridge is attached inside the accommodation portion and forces the developer discharging orifice to open by activating the shutter mechanism, and a spiral feeder that is internally attached to the developer receiving and discharging pipe and receives and discharges the developer inside the toner cartridge; the spiral feeder rotates on its axis about a center of its shaft while revolving about a tube center of the cartridge accommodation portion in response to a circulation of the developer discharging orifice caused by a rotation of the toner cartridge in a state where the developer receiving and discharging pipe is inserted into the developer discharging orifice.

According to this configuration, when the toner cartridge is attached to the accommodation portion, the developer receiving and discharging pipe is inserted relatively into the developer discharging orifice of the toner cartridge so that the shutter is opened. By rotating the toner cartridge by the driving of the drive motor in this state, the developer receiving and discharging pipe also circulates with the circulation of the developer discharging orifice in association with the rotation of the toner cartridge. When this circulation is transmitted to the spiral feeder, the spiral feeder rotates about the center of its shaft while revolving about the tube center of the cartridge accommodation portion. Accordingly, the developer discharged into the developer receiving and discharging pipe through the developer discharging orifice is transported through the developer receiving and discharging pipe by the rotation of the spiral feeder on its axis and replenished to the developing device. It thus becomes possible to transmit the revolution of the developer receiving and discharging pipe in the form of the rotation of the spiral feeder on its axis. This eliminates the need to provide an exclusive-use drive source to drive the spiral feeder, which can in turn contribute to a reduction in the cost of the apparatus.

The invention claimed is:

1. A toner cartridge comprising:

a cartridge main body defining a container having first and second opposed end walls and a tubular barrel extending between the end walls, the container being at least partly filled with a developer, a discharging orifice for discharging the developer being provided in the first end wall, and at least one protrusion provided to the first end wall and protruding toward the second end wall, wherein the barrel has at least in part a portion whose outer shape of a cross section orthogonal to a direction of a tube center line is a shape of a curve of constant width other than a circle.

2. The toner cartridge according to claim 1, wherein:

the shape of the curve of constant width is a shape of a Reuleaux polygon.

3. The toner cartridge according to claim 1, wherein:

the developer discharging orifice is provided at a position of a center of gravity of the curve of constant width of the one of the pair of end walls.

4. The toner cartridge according to claim 3, further comprising:

a shutter mechanism that opens and closes the developer discharging orifice, wherein the shutter mechanism includes a shutter plate that closes the developer discharging orifice from inside the cartridge main body in a re-openable manner and a biasing member that biases the shutter plate toward the developer discharging orifice.

5. The toner cartridge according to claim 1, wherein:

a rib for developer transportation is provided on an inner peripheral surface of the barrel so as to protrude inward.

6. The toner cartridge according to claim 1, wherein:

the outer shape of the cross-section of the barrel orthogonal to the tube center line is a triangle.

7. An image forming apparatus, characterized by comprising:

an apparatus main body of a box shape in which various image forming devices are provided;

a toner cartridge, which is attached detachably to the apparatus main body, wherein the toner cartridge includes a cartridge main body as a container having a tubular barrel and filled with a developer, wherein the barrel has at least in part a portion whose outer shape of a cross section orthogonal to a direction of a tube center line is a shape of a curve of constant width other than a circle;

an accommodation portion including an inner surface with which an outer peripheral surface of the barrel of the toner cartridge comes into sliding contact and an opening provided to one end face through which the toner cartridge is attached and detached and having a cross section in a direction orthogonal to a direction of a tube center line in a shape of a regular tetragon;

a rotation mechanism configured to rotate the toner cartridge attached to the accommodation portion in a circumferential direction; and a transportation mechanism configured to transport the developer inside the toner cartridge to image forming components provided inside the apparatus main body through a developer discharging orifice provided to the toner cartridge.

8. The image forming apparatus according to claim 7, wherein:

the accommodation portion is provided with a notch window notched so as to traverse a wall surface that defines the accommodation portion; and the rotation mechanism includes, a drive belt that circulates while abutting on an outer peripheral surface of the toner cartridge in a state where the drive belt fits into the accommodation portion from the notch window, a drive roller and a driven roller over which the drive belt is looped, and a drive motor that drives the drive roller to rotate.

9. The image forming apparatus according to claim 7, wherein:

a developer discharging orifice is provided about a position of a center of gravity of the barrel in the end wall of the toner cartridge;

the transportation mechanism includes, a developer receiving and discharging pipe that is inserted relatively into the developer discharging orifice in a state where the toner cartridge is attached inside the accommodation portion and forces the developer discharging orifice to open by activating a shutter mechanism, and a spiral feeder that is internally attached to the developer receiving and discharging pipe and receives and discharges the developer inside the toner cartridge; and the spiral feeder rotates on its axis about a center of its shaft while revolving about a tube center of the cartridge accommodation portion in response to a circulation of the developer discharging orifice caused by a rotation of the toner cartridge in a state where the developer receiving and discharging pipe is inserted into the developer discharging orifice.

10. An image forming apparatus, characterized by comprising:

an apparatus main body of a box shape in which various image forming devices are provided;

a toner cartridge, which is attached detachably to the apparatus main body, wherein the toner cartridge includes a cartridge main body as a container having a tubular barrel and filled with a developer, wherein the barrel has at least in part a portion whose outer shape of a cross section orthogonal to a direction of a tube center line is a shape of a curve of Reuleaux polygon;

an accommodation portion including an inner surface with which an outer peripheral surface of the barrel of the toner cartridge comes into sliding contact and an opening provided to one end face through which the toner cartridge is attached and detached and having a cross section in a direction orthogonal to a direction of a tube center line in a shape of a regular polygon;

a rotation mechanism configured to rotate the toner cartridge attached to the accommodation portion in a circumferential direction; and a transportation mechanism configured to transport the developer inside the toner cartridge to image forming components provided inside the apparatus main body through a developer discharging orifice provided to the toner cartridge, wherein:

the regular polygon is a 2n (where n is a natural number equal to 3 or larger) polygon; and a shape of the Reuleaux polygon of the toner cartridge is almost a Reuleaux (2n−1) polygon.

* * * * *